US009263015B2

(12) United States Patent
Juszkiewicz

(10) Patent No.: US 9,263,015 B2
(45) Date of Patent: Feb. 16, 2016

(54) WIRELESS ELECTRIC GUITAR

(75) Inventor: Henry E. Juszkiewicz, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 278 days.

(21) Appl. No.: 13/882,193

(22) PCT Filed: Oct. 28, 2011

(86) PCT No.: PCT/US2011/058193

§ 371 (c)(1),
(2), (4) Date: Jun. 21, 2013

(87) PCT Pub. No.: WO2012/058497

PCT Pub. Date: May 3, 2012

(65) Prior Publication Data

US 2014/0150630 A1 Jun. 5, 2014

Related U.S. Application Data

(60) Provisional application No. 61/407,703, filed on Oct. 28, 2010.

(51) Int. Cl.

| | |
|---|---|
| ***G10H 1/02*** | (2006.01) |
| ***G10H 1/44*** | (2006.01) |
| ***G10H 3/18*** | (2006.01) |
| ***G10H 1/00*** | (2006.01) |

(52) U.S. Cl.

CPC ..... *G10H 1/02* (2013.01); *G10H 1/0083* (2013.01); *G10H 1/0091* (2013.01); *G10H 1/44* (2013.01); *G10H 3/18* (2013.01); *G10H 3/188* (2013.01)

(58) Field of Classification Search

CPC ..... G10H 3/18; G10H 1/0058; G10H 1/0066; G10H 1/46; G10H 3/186; G10H 1/0008; G10H 2240/211; G10H 1/0091; G10H 1/0083; G10H 2210/281; G10H 1/02; G10H 2210/311; G10H 2210/231; G10H 2210/235; G10H 2210/155; G10H 2210/211; G10H 2240/321

See application file for complete search history.

(56) References Cited

U.S. PATENT DOCUMENTS

| | | | | | |
|---|---|---|---|---|---|
| 4,919,031 | A * | 4/1990 | Matsumoto | 84/601 |
| 5,024,134 | A * | 6/1991 | Uchiyama | 84/654 |
| 5,025,703 | A * | 6/1991 | Iba et al. | 84/718 |
| 5,085,120 | A * | 2/1992 | Ishiguro | 84/737 |
| 6,787,690 | B1 * | 9/2004 | Celi et al. | 84/723 |
| 8,509,692 | B2 * | 8/2013 | Ryle et al. | 455/41.3 |
| 8,546,675 | B1 * | 10/2013 | Hirshberg | 84/654 |
| 2004/0187673 | A1 * | 9/2004 | Stevenson | 84/737 |
| 2005/0045027 | A1 * | 3/2005 | Celi et al. | 84/723 |

(Continued)

*Primary Examiner* — Marlon Fletcher
(74) *Attorney, Agent, or Firm* — Bates & Bates, LLC

(57) ABSTRACT

An electronics module for an electric guitar is provided. The electronics module includes a processor, a plurality of controls, an antenna, and a computer-readable medium. The processor receives an audio signal generated by a vibration of a plurality of strings of the electric guitar. The plurality of controls are operably coupled to the processor and provide a mechanism for adjusting a sound created from the audio signal. The computer-readable medium is operably coupled to the processor and configured to cause the electric guitar to determine a control of the plurality of controls associated with the received effects parameter; adjust a state of the determined control based on the received effects parameter; modify the audio signal based on the plurality of controls and on the received effects parameter; and output the modified audio signal through the antenna to a second device.

13 Claims, 9 Drawing Sheets

(56) References Cited

U.S. PATENT DOCUMENTS

| | | | | |
|---|---|---|---|---|
| 2006/0156912 | A1* | 7/2006 | Annis et al. | 84/742 |
| 2007/0234880 | A1* | 10/2007 | Adams et al. | 84/601 |
| 2007/0251374 | A1* | 11/2007 | Armstrong-Muntner | 84/735 |
| 2009/0100988 | A1* | 4/2009 | Villa et al. | 84/601 |
| 2011/0028218 | A1* | 2/2011 | Gomes et al. | 463/39 |
| 2011/0146480 | A1* | 6/2011 | Robertson | 84/735 |
| 2011/0174138 | A1* | 7/2011 | Loh et al. | 84/645 |
| 2013/0034240 | A1* | 2/2013 | Crawford | 381/77 |
| 2013/0058507 | A1* | 3/2013 | Arkn S-Pedersen et al. | 381/122 |
| 2014/0096667 | A1* | 4/2014 | Chapman et al. | 84/609 |
| 2014/0260906 | A1* | 9/2014 | Welch | 84/603 |
| 2015/0040744 | A1* | 2/2015 | Redding et al. | 84/726 |

* cited by examiner

WIRELESS ELECTRIC GUITAR

CROSS-REFERENCE TO RELATED APPLICATION

This application claims priority to U.S. Provisional Patent Application Ser. No. 61/407,703, filed Oct. 28, 2010, and PCT Patent Application No. PCT/US2011/058193, filed Oct. 28, 2011, both of which are hereby incorporated by reference in their entirety.

BACKGROUND

Guitars are well known in the art and include a wide variety of different types and designs such as various types of acoustic and electric guitars. Guitar players and other musicians often modify the sound produced by the guitar to create a virtually endless variety of sounds. Example effects include: compression, tremolo, distortion, overdrive, fuzz, wah-wah, chorus, flange, phase shift, pitch shift, harmony, vibrato, delay (echo), reverberation (reverb), etc., which modify the audio signal produced by the guitar strings in various ways using mechanical, electrical, and electro-mechanical mechanisms.

A compression effect stabilizes the volume and "smooths" a note's "attack" by dampening its onset and amplifying its sustain and can be produced by varying the gain of a signal to ensure the volume stays within a specific dynamic range. A tremolo effect produces a slight, rapid variation in the volume of a note or chord. Tremolo effects normally have a "rate" knob, which allows a musician to change the speed of the variation. Distortion effects distort the tone of an instrument by adding "overtones", creating various sounds such as a warm" sound or a "dirty" or "gritty" sound, which may be produced by re-shaping or "clipping" the sound waves produced so that they have flat, mesa-like peaks, instead of curved ones. Overdrive effects are similar to distortion effects except that an overdrive producing device produces "clean" sounds at quieter volumes and distorted sounds at louder volumes. A fuzz effect clips a sound wave until it is nearly a square-wave, resulting in a heavily distorted sound. A wah-wah effect results in vowel-like sounds, which are created by altering the frequency spectrum of the analog signal produced by the guitar. A chorus effect mimics the "phase locking" effect produced naturally by choirs and string orchestras when sounds with very slight differences in timbre and pitch assimilate with one another. A chorus effect splits the electrical signal, adding slight frequency variations to part of the signal while leaving the rest unaltered. A flange effect simulates a studio effect produced by holding the edge of the audio tape reel to momentarily slow down a recording. As a result, a flange effect adds a variably delayed version of the sound to the original sound creating a comb filter effect. A phaser causes a phase shift effect, which creates a slight rippling effect by adding out-of-phase duplicate sound-waves to the original sound-waves. A pitch shift effect raises or lowers (e.g. "transposes") each note a musician plays by a pre-set interval. For example, a pitch shifter set to increase the pitch by a fourth raises each note four diatonic intervals above the notes actually played by the musician. A harmony effect is a type of pitch shift effect that combines the altered pitch with the original pitch to create a two or more note harmony. A vibrato effect produces slight, rapid variations in pitch, mimicking the fractional semitone variations produced naturally by opera singers and violinists when prolonging a single note. Vibrato effects often allow the musician to control the rate of the variation as well as the difference in pitch. A delay effect adds a duplicate electrical signal to the original signal at a slight time-delay. The effect can either be a single echo or multiple echoes. A reverb effect simulates sounds produced in an echo chamber by creating a large number of echoes that gradually fade or "decay".

Additionally, other signal processing of the audio signals may remove or reduce noise. For example, a noise gate reduces "hum", "hiss", and "static" by eliminating sounds below a certain gain threshold. Still other signal processing utilizes an equalizer, which is a set of filters that strengthen or weaken specific frequency regions. For example, an equalizer may adjust the bass and treble and may be used to enhance particular aspects of an instrument's tone.

Application of the various sound effects can be applied using devices in the guitar itself and/or pedal boxes, amplifiers, mixers, etc. that receive the audio signals in either analog or digital form from the guitar. The application of the various sound effects may be controlled at the guitar and/or at the effects device. The guitar and/or effects devices may use digital signal processing (DSP) to apply the desired sound modifications to the analog sound produced by the guitar strings.

The analog signal varies in output level and impedance, is subject to capacitance and other environmental distortions, and can be subject to ground loops and other kinds of electronic noise. After being degraded in such fashion by the environment, the analog signal is often digitized at some point, with the digitized signal including the noise component. The analog or digital signal may be communicated to various other devices such as the effects devices at various points in the signal processing path.

SUMMARY

In an example embodiment, an electronics module for an electric guitar is provided. The electronics module includes a processor, a plurality of controls, an antenna, and a computer-readable medium. The processor receives an audio signal generated by a vibration of a plurality of strings of the electric guitar. The plurality of controls are operably coupled to the processor and provide a mechanism for adjusting a sound created from the audio signal. As used herein, the term "operably coupled" indicates two components are electrically, mechanically, or electro-mechanically connected either directly or indirectly through other intermediate devices. The antenna is operably coupled to the processor and receives a wireless signal including an effects parameter from a first device. The computer-readable medium is operably coupled to the processor and configured to cause the electric guitar to determine a control of the plurality of controls associated with the received effects parameter; adjust a state of the determined control based on the received effects parameter; modify the audio signal based on the plurality of controls and on the received effects parameter; and output the modified audio signal through the antenna to a second device.

In another example embodiment, an electric guitar is provided. The electric guitar includes a body, a plurality of strings, and the electronics module. The body includes a base, a neck, and a headstock. The base includes a tailpiece. The neck is mounted to and extends from an end of the base. The headstock is mounted to and extends from an end of the neck opposite the base. The neck includes a plurality of string posts. The plurality of strings are mounted at a first end to the tailpiece and at a second end to the plurality of string posts.

In yet another example embodiment, a sound system is provided. The sound system includes a sound receiving/producing device, a control device, and the electric guitar.

Other principal features and advantages of the invention will become apparent to those skilled in the art upon review of the following drawings, the detailed description, and the appended claims.

BRIEF DESCRIPTION OF THE DRAWINGS

Illustrative embodiments of the invention will hereafter be described with reference to the accompanying drawings, wherein like numerals denote like elements.

DETAILED DESCRIPTION

Figure 1:
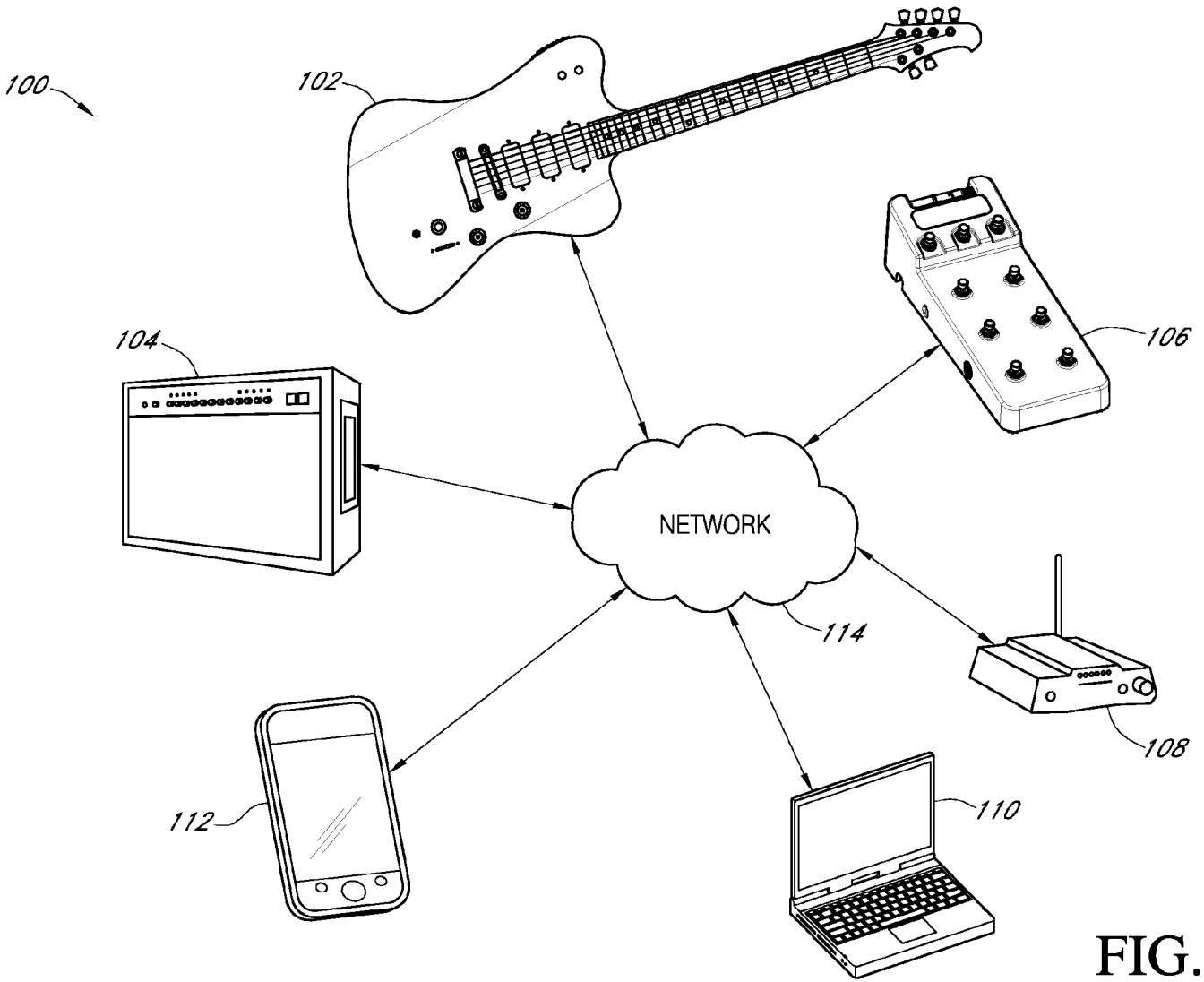
FIG. 1 depicts a block diagram of a sound system in accordance with an illustrative embodiment.

With reference to FIG. 1, a block diagram of a sound system 100 is shown in accordance with an illustrative embodiment. In an illustrative embodiment, sound system 100 may include one or more guitars 102, one or more amplifiers 104, one or more footswitch controllers 106, one or more interface devices 108, one or more computing devices, and a network 114. Network 114 can be any type of wired and/or wireless public or private network including a cellular network, a local area network, a wide area network such as the Internet, etc. Network 114 further may be comprised of subnetworks of the same or different types which consist of any number of devices. Any of the one or more guitars 102, the one or more amplifiers 104, the one or more footswitch controllers 106, the one or more interface devices 108, and/or the one or more computing devices may communicate with each other using a portion of network 114 that is wired or wireless. The one or more amplifiers 104, the one or more footswitch controllers 106, the one or more interface devices 108, and/or the one or more computing devices may act as control devices that control the setting or adjustment of sound effects at any of the one or more guitars 102.

Network 114 may be a peer-to-peer network. Sound system 100 may include additional types of devices such as sound mixers, headphones, microphones, other musical instruments, etc. that also communicate through network 114. The one or more amplifiers 104, the one or more interface devices 108, the one or more computing devices, the sound mixers, the headphones, and/or the microphones may act as sound receiving/producing devices that receive an audio signal directly or indirectly from any of the one or more guitars 102 and reproduce the received audio signal so that the audio signal is audible by a user of sound system 100.

The one or more computing devices may include computers of any form factor such as a laptop 110, a personal digital assistant 112, a tablet computer, a desktop, an integrated messaging device, a cellular telephone, a smart phone, etc. The one or more computing devices may receive and send information and audio data related to sound and other effects generated by other devices within sound system 100.

The one or more guitars 102 are electric guitars designed to use the principle of electromagnetic induction to convert string vibration into an electrical signal. Because the output of an electric guitar is an electrical signal, the electrical signal may be altered using electronic circuits and/or signal processing techniques to include various effects in the electrical signal, such as reverb and distortion, which modify the tone and characteristics of the electrical signal.

The one or more speakers 104 convert the electrical signal into sound that is audible by the human ear. The one or more footswitch controllers 106 allow a user to control application of the different types of effects on the electric signal produced by the one or more guitars 102 by depressing one or more buttons mounted to the one or more footswitch controllers 106. As used herein, the term "mount" includes join, unite, connect, associate, insert, hang, hold, affix, attach, fasten, bind, paste, secure, bolt, screw, rivet, solder, weld, press against, and other like terms. Additionally, use of the term "mount" may indicate a direct or an indirect connection between the described components/devices.

The one or more interface devices 108 provide an interface between the one or more guitars 102 and the one or more computing devices and/or the one or more speakers 104. The one or more interface devices 108 may include both wired and wireless connectors for interfacing between the devices. The one or more interface devices 108 further may include a computer-readable medium or a drive for the computer-readable medium on which the electrical signal or modified electrical signal may be stored.

Figure 2:
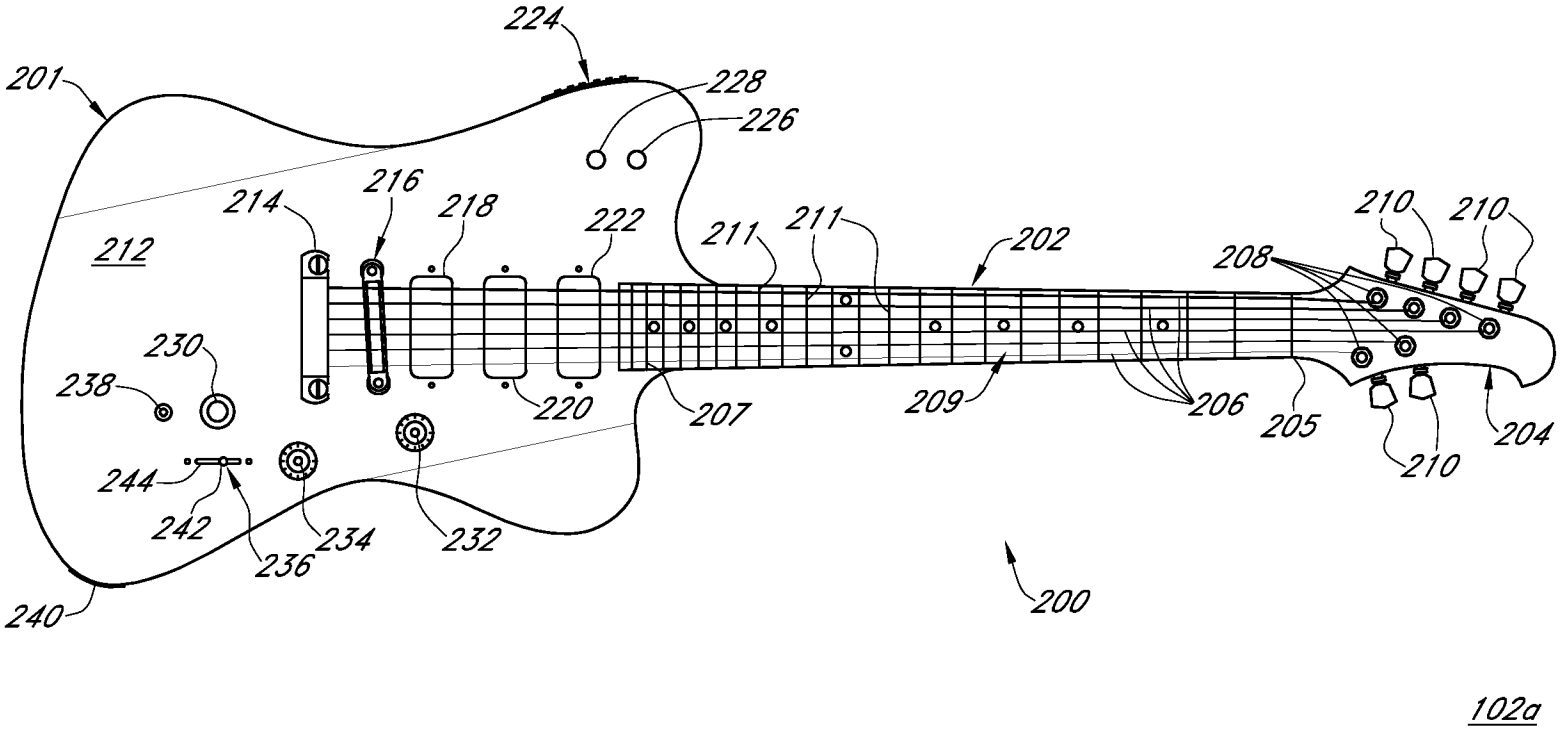
FIG. 2 depicts a top view of a guitar used as part of the sound system of FIG. 1 in accordance with an illustrative embodiment.

With reference to FIG. 2, a top view of a guitar 102*a* of the one or more guitars 102 of sound system 100 is shown in accordance with an illustrative embodiment. In an illustrative embodiment, guitar 102*a* may include a body 200, a plurality of strings 206, a plurality of string posts 208, a plurality of tuning knobs 210, a guitar face 212, a tailpiece 214, a bridge 216, a bridge electromagnetic pickup 218, a center electromagnetic pickup 220, a neck electromagnetic pickup 222, a fader bank 224, a tape effect control 226, a distortion control 228, a master control knob 230, a volume control 232, a tone control 234, a switch 236, a mode control 238, and an audio connector 240. A fewer or a greater number of controls may be used and may be positioned at different locations than those illustrated.

Body 200 may include a base 201, a neck 202, and a headstock 204. Switch 236 may include a slider knob 242 configured to slide within a slider slot 244 to change a selection indicated using switch 236. In the illustrative embodiment of FIG. 2, guitar 102*a* is a six-string electric guitar though a fewer or a greater number of strings may be used. The plurality of strings 206 extend from the plurality of string posts 208, above fingerboard 209, across bridge 216, and mount to tailpiece 214 under tension as understood by a person of skill in the art.

In an illustrative embodiment, base 201 is lightweight and may be formed using a variety of materials including wood, polycarbonate, plastic, etc. Example woods include alder, swamp ash, mahogany, poplar, basswood, maple, etc. Base 201 may be partially solid and partially hollow to accommodate wiring and other electronic components. Base 201 is typically sized and shaped to be held comfortably by a user.

In the illustrative embodiment of FIG. 2, neck 202 is asymmetrical and includes a smooth, non-stick finish. A volute at nut 205 allows a hand of a user of guitar 102*a* to quickly find the first position and improves a total sustain and strength of the plurality of strings 206. Neck 202 is mounted to base 201 at a neck joint 207 to allow maximum access to the plurality of strings 206. Neck 202 may be formed using a variety of materials including wood, graphite, etc. Example woods include alder, swamp ash, mahogany, poplar, basswood, maple, etc.

Neck 202 includes a fingerboard 209 that includes a plurality of frets 211. Fingerboard 209 may be laminated to a front of neck 202. The plurality of strings 206 extend above fingerboard 209. Fingerboard 209 may be formed using a variety of materials including wood, carbon-fiber, etc. and may include a variety of inlays formed of various materials. The plurality of frets 211 are raised strips of hard material that extend perpendicular to the plurality of strings 206 against which one or more of the plurality of strings 206 are pressed to change their vibrating length. In the illustrative embodiment of FIG. 2, fingerboard 209 includes 23 frets allowing the user to achieve a full two octave range with a bend.

In the illustrative embodiment of FIG. 2, headstock 204 is mounted to neck 202 at an end opposite base 201 and includes the plurality of string posts 208 and the plurality of tuning knobs 210. Each string of the plurality of strings 206 is mounted to a single string post of the plurality of string posts 208. Each string post of the plurality of string posts 208 is connected to a single tuning knob of the plurality of tuning knobs 210. A user may manually adjust the plurality of tuning knobs 210 to adjust a tension on the respective string as known to a person of skill in the art. Additionally, the tension on each string of the plurality of strings 206 may be adjusted using motors to automatically tune guitar 102*a*.

In the illustrative embodiment of FIG. 2, tailpiece 214, bridge 216, bridge electromagnetic pickup 218, center electromagnetic pickup 220, neck electromagnetic pickup 222, tape effect control 226, distortion control 228, master control knob 230, volume control 232, tone control 234, switch 236, and mode control 238 are mounted to guitar face 212 of base 201, whereas fader bank 224 and audio connector 240 are mounted on a side of base 201 though other arrangements may be used.

Tailpiece 214 includes an anchor for the plurality of strings 206. In an illustrative embodiment, one or more contacts may be mounted in tailpiece 214. The one or more contacts may be used for communication between a first microprocessor mounted in base 201 and a second microprocessor mounted in neck 202 and/or headstock 204. The one or more contacts may provide power to the second microprocessor as well as other circuitry mounted in neck 202 and/or headstock 204 and may transmit control data from the first microprocessor to the second microprocessor, for example, to control automatic tuning of the plurality of strings 206 using motors to adjust a rotation of the plurality of string posts 208.

A miniature boundary microphone (not shown) may be mounted under tailpiece 214 so that the user's hand or arm does not cover the microphone and to protect the microphone from dirt and dust. The microphone may provide a smooth flat, uncolored response and act as a sample of the ambient environment surrounding guitar 102*a* to provide accurate data for use in making signal adjustments based on a reference point provided by the microphone. For example, a micro burst of white noise may be output from guitar 102*a*, received by the microphone, and used to adjust a sound parameter, which results in a more consistent and authentic sound.

Bridge 216 supports and holds the plurality of strings 206 in place relative to guitar face 212 of base 201. Bridge 216 may further include a piezoelectric pickup (not shown) to generate a piezoelectric signal. The piezoelectric pickup may include a crystal located under each string of the plurality of strings 206 and in a saddle of bridge 216 to generate a piezoelectric signal for each string of the plurality of strings 206. When a string of the plurality of strings 206 vibrates, a shape of the crystal is distorted, and the stresses associated with this change in shape produce a voltage across the crystal that is detected by the piezoelectric pickup. The piezoelectric pickup may be mounted under bridge 216 or form part of bridge 216. The piezoelectric pickup allows guitar 102*a* to replicate an acoustic instrument.

Bridge electromagnetic pickup 218, middle electromagnetic pickup 220, and neck electromagnetic pickup 222 are transducers that detect (or "pick up") the vibrations generated by the plurality of strings 206 and convert the mechanical energy into electrical energy. Bridge electromagnetic pickup 218 is positioned below the plurality of strings 206 and closest to bridge 216. Neck electromagnetic pickup 222 is positioned below the plurality of strings 206 and closest to neck 202. Middle electromagnetic pickup 220 is positioned below the plurality of strings 206 and between bridge electromagnetic pickup 218 and neck electromagnetic pickup 222. Bridge electromagnetic pickup 218, middle electromagnetic pickup 220, and neck electromagnetic pickup 222 contain magnets that are tightly wrapped in one or more coils of wire. In an illustrative embodiment, one or more of bridge electromagnetic pickup 218, middle electromagnetic pickup 220, and neck electromagnetic pickup 222 are double-coil, humbucker type electromagnetic pickups. Each coil of bridge electromagnetic pickup 218, middle electromagnetic pickup 220, and neck electromagnetic pickup 222 may be individually controlled to be on, off, or on-reverse polarity. Guitar 102*a* may include a fewer or a greater number of electromagnetic pickups.

Figure 3:
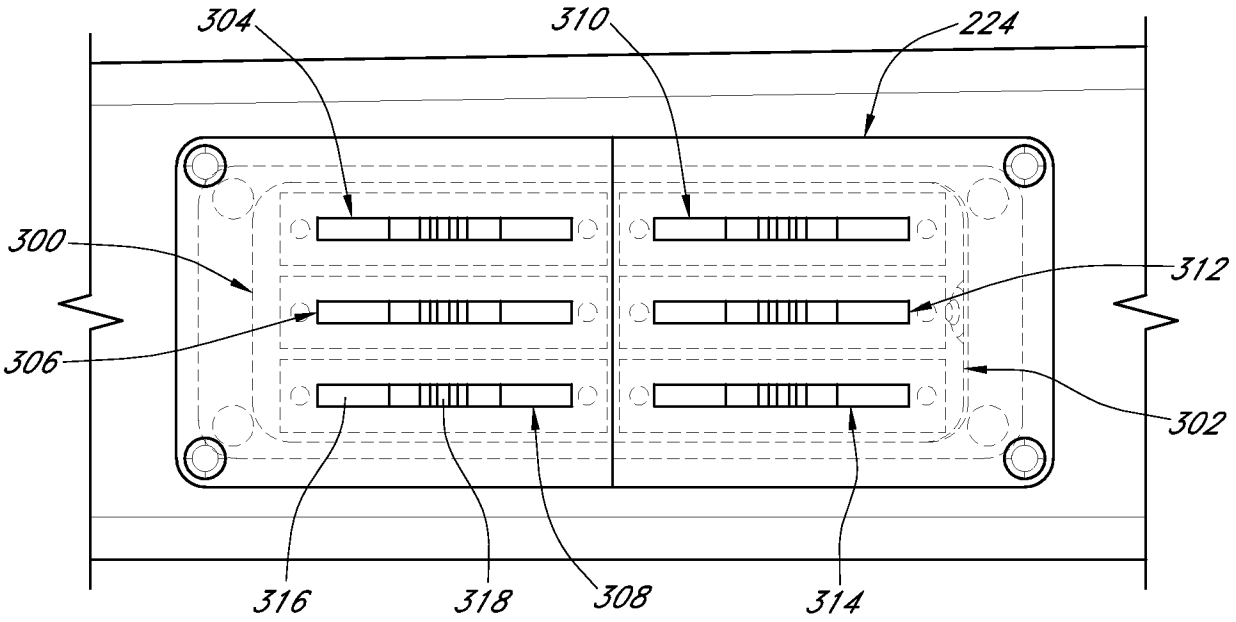
FIG. 3 depicts a partial side view of the guitar of FIG. 2 showing a fader bank in accordance with an illustrative embodiment.

With reference to FIG. 3, a side view of a portion of guitar 102*a* is shown in accordance with an illustrative embodiment. In an illustrative embodiment, fader bank 224 is mounted on a side of guitar 102*a* though other mounting locations may be used in alternative embodiments. Fader bank 224 may include a first fader bank 300 and a second fader bank 302. First fader bank 300 may be associated with a setting of tape effect control 226 and may include a first fader control 304, a second fader control 306, and a third fader control 308. Second fader bank 302 may be associated with a setting of distortion control 228 and may include a fourth fader control 310, a fifth fader control 312, and a sixth fader control 314. Each of first fader control 304, second fader control 306, third fader control 308, fourth fader control 310, fifth fader control 312, and sixth fader control 314 may include a fader slider slot 316 and a fader slider knob 318. A user may adjust a fade level setting by pressing on and sliding fader slider knob 318 within fader slider slot 316. Each fader control can be adjusted independently.

Figure 4A:
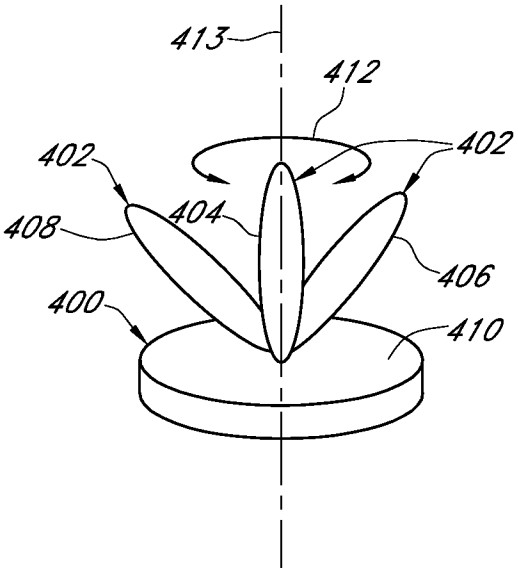
FIGS. 4*a* and 4*b* depict a three-way toggle potentiometer included in the guitar of FIG. 2 in accordance with an illustrative embodiment.
Figure 4B:
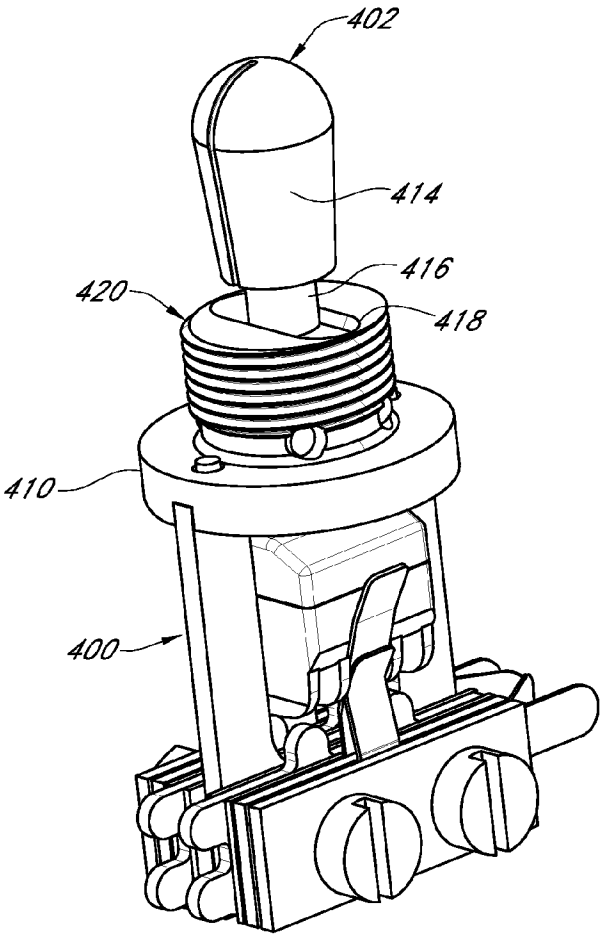

With reference to FIGS. 4*a* and 4*b*, a three-way toggle potentiometer 400 is shown in accordance with an illustrative embodiment. Three way toggle potentiometer 400 includes a switch 402 and a base 410. Switch 402 can be positioned in a plurality of positions: a first position 404, a second position 406, and a third position 408. The toggle potentiometer may be configured to provide a fewer or a greater number of positions. As shown with reference to FIGS. 4*a* and 4*b*, switch 402 is mounted to rotate within base 410 as shown by a rotation plane 412. Rotation plane 412 is perpendicular to an axis 413 extending through a center of switch 402.

Switch 402 includes a switch head 414 mounted to and extending from a switch shaft 416. Switch shaft 416 is mounted within a ring slot 418 of a switch ring 420. Switch ring 420 rotates within base 410 when switch head 414 is rotated in rotation plane 412 by a user. Switch head 414 toggles forward and/or backward within ring slot 418 when switch head 414 is moved from first position 404, which is generally perpendicular to a plane defined by base 410, to second position 406 and/or third position 408. Rotation of switch head 414 causes a first parameter, a second parameter, or a third parameter associated with first position 404, second position 406, and third position 408, respectively, to be adjusted based on the direction and amount of rotation.

With continuing reference to FIG. 2, and in an illustrative embodiment, tape effect control 226 includes three-way toggle potentiometer 400. The position of tape effect control 226 determines a tape type effect applied to the electrical signal generated by the pickups 218, 220, 222 and/or the piezoelectric pickup. Tape type effects include reverberation, delay, and modulation. As an example, tape effect control 226 positioned in first position 404 controls a delay (echo) effect; tape effect control 226 positioned in second position 406 controls a reverberation effect; and tape effect control 226 positioned in third position 408 controls a modulation effect. The three effects can be individually controlled and dialed in, but may be applied in series.

First fader control 304, second fader control 306, and third fader control 308 of first fader bank 300 may be motorized or non-motorized faders, which provide parameter control based on the toggle position of tape effect control 226. When tape effect control 226 is positioned in first position 404 to control the delay effect, first fader control 304 may be connected to adjust a delay time, second fader control 306 may be connected to adjust a feedback level, and third fader control 308 may be connected to select a type of delay effect. As a result, first fader control 304 controls the amount of delay used to create the delay (echo) effect. The range of delay values controlled by first fader control 304 depends on the type of delay effect selected. Second fader control 306 controls the amount of feedback used in creating the delay effect. The range of feedback values controlled by second fader control 306 depends on the type of delay effect selected. Third fader control 308 allows selection from a plurality of types of delay effects. For example, the types of delay effects may include digital delay, analog delay, tape echo, reverse delay, dynamic delay, etc.

When tape effect control 226 is positioned in second position 406 to control the reverberation effect, a reverberation effect is applied that includes a combination of spring and "room tone" reverberations. A plurality of cabinet types (e.g., 1×12, 2×12, 4×10, and 4×12) may be defined from a collection of amplifiers and the sound effects measured and tested. For each cabinet type selected, different reverberation effects are selected based on the sound measurements. Several different cabinet styles including open backed and close backed cabinets with different microphone positions in addition to direct modes with no cabinet modeling may be included for selection. When tape effect control 226 is positioned in second position 406 to control the reverberation effect, first fader control 304 may be connected to adjust a reverberation decay level, second fader control 306 may be connected to adjust a feedback level, and third fader control 308 may be connected to select a type level from spring to lush. As a result, first fader control 304 controls the amount of low pass filtering used to create the reverberation effect by adjusting both how rapidly the reverberation decays and how bright the reverberation sounds compared to the original signal. Second fader control 306 controls the amount of feedback used in creating the reverberation effect. The range of feedback values controlled by second fader control 306 depends on the type of reverberation effect selected. Third fader control 308 allows selection from a plurality of types of reverberation effects. For example, the type of reverberation effect may be related to the cabinet style.

When tape effect control 226 is positioned in third position 408 to control the modulation effect, first fader control 304 may be connected to adjust a depth level or perceived intensity of the modulation effect, second fader control 306 may be connected to adjust a rate of the modulation effect, and third fader control 308 may be connected to select a type of modulation. As a result, first fader control 304 controls adjustment of a delay time step, which controls how quickly the effect oscillates. Second fader control 306 controls adjustment of the amount of delayed signal fed back into the input of the delay line per second. Third fader control 308 allows selection from a plurality of types of modulation effects. For example, the types of modulation effects may include chorus, vibrato, tremolo, phasing, flanging, etc.

Rotation of tape effect control 226 in either first position 404, second position 406, or third position 408 results in an adjustment in a strength value of the corresponding effect similar to the way a wet/dry control works on a mixer. A zero value corresponds to no effect (dry) and a full rotation corresponds to 100% of the effect (wet). Thus, rotation of tape effect control 226 varies the balance between the dry (undelayed) and wet (delayed) signals. As a result, an input value based on rotation of tape effect control 226 in either first position 404, second position 406, or third position 408 may result in a value from 0 to 1.

In an illustrative embodiment, distortion control 228 includes three-way toggle potentiometer 400. The position of distortion control 228 determines a distortion effect applied to the electrical signal generated by the pickups 218, 220, 222 and/or the piezoelectric pickup. Distortion effects may be separated into distortion, equalization, and compression effects. As an example, distortion control 228 positioned in first position 404 controls a distortion effect; distortion control 228 positioned in second position 406 controls an equalizer effect; and distortion control 228 positioned in third position 408 controls a compressor effect. The three effects can be individually controlled and dialed in by a user of guitar 102*a*.

Fourth fader control 310, fifth fader control 312, and sixth fader control 314 of second fader bank 302 may be motorized or non-motorized faders, which provide parameter control based on the toggle position of distortion control 228. When distortion control 228 is positioned in first position 404 to control the distortion effect, first fader control 304 may be connected to select a type of distortion effect, second fader control 306 may be connected to adjust a distortion amount, and third fader control 308 may be connected to adjust an output gain. For example, the types of distortion effects may include light, light 2, medium, heavy, shred, screamer, and overdrive. The type of distortion selected can affect multiple effects simultaneously. For example, changing the distortion type may affect the prefilter, drive, cabinet simulator, distortion, overdrive, and equalizer effects simultaneously.

When distortion control 228 is positioned in second position 406 to control the equalizer effect, first fader control 304 may be connected to adjust a first gain value for a high shelf equalizer, second fader control 306 may be connected to adjust a second gain value for a parametric equalizer, and third fader control 308 may be connected to adjust a third gain value for a low shelf equalizer. For example, the high shelf equalizer may be associated with a frequency range of 4 kilohertz (kHz) to 15 kHz; the parametric equalizer may be associated with a frequency range of 0.4 kilohertz (kHz) to 4 kHz; and the low shelf equalizer may be associated with a frequency range of 40 hertz (Hz) to 400 Hz.

When distortion control 228 is positioned in third position 408 to control the compressor effect, first fader control 304 may be connected to adjust a sustain time constant, second fader control 306 may be connected to adjust a compressor threshold, and third fader control 308 may be connected to adjust a noise gate threshold.

Rotation of distortion control 228 in either first position 404, second position 406, or third position 408 results in an adjustment in a strength value of the corresponding effect similar to the way a wet/dry control works on a mixer. A zero value corresponds to no effect and a full rotation corresponds to 100% of the effect.

In an illustrative embodiment, mode control 238 includes three-way toggle potentiometer 400. The position of mode control 238 determines a guitar mode. For example, mode control 238 may be used to adjust the pickup configuration of pickups 218, 220, 222 and the blend of the piezoelectric signal with the electromagnetic pickup signal. As an example, mode control 238 positioned in first position 404 controls a piezoelectric blend value; mode control 238 positioned in second position 406 controls a tuning value; and mode control 238 positioned in third position 408 controls a pickup mode. Rotation of mode control 238 in first position 404 results in an adjustment in a proportion of the piezoelectric signal relative to the magnetic pickup signal. A zero value corresponds to no piezoelectric signal and a full rotation corresponds to 100% piezoelectric signal.

Rotation of mode control 238 in second position 406 results in an adjustment in the tuning of the plurality of strings 206. For example, if mode control 238 is rotated, a next tuning setting is selected. In an illustrative embodiment, mode control 238 may allow selection of eleven different tuning settings though a fewer or a greater number of tuning settings may be selectable. Each tuning setting recalls every parameter that defines creation of that tune using guitar 102*a*. For example, a tuning name and a frequency value for each of the plurality of strings 206 may be defined for each of the tuning settings. When a tuning setting is selected, the tuning of each of the plurality of strings 206 is automatically adjusted to the respective frequency value stored for that tuning setting.

Rotation of mode control 238 in third position 408 results in an adjustment in the pickup mode, which controls the configuration of the electromagnetic pickups, i.e., which coils of bridge electromagnetic pickup 218, center electromagnetic pickup 220, and neck electromagnetic pickup 222 are active and the phase of the coils. In an illustrative embodiment, mode control 238 may allow selection of eleven different pickup mode settings though a fewer or a greater number of pickup mode settings may be selectable. For example, in the illustrative embodiment of FIG. 2, guitar 102*a* has three electromagnetic pickups, each with two coils. The coils are configured by analog switches that are controlled by a processor of guitar 102*a*. Each pickup can be put in one of thirteen unique configurations providing a total of 13*13*13=2,197 possible configurations for the combination of all three pickups. Rotation of mode control 238 in third position 408 allows a selection among the most commonly used pickup configurations. Each pickup configuration indicates if the pickup is active and if it is configured as a single coil or double coil.

In an illustrative embodiment, volume control 232 includes a potentiometer used to select a volume level for the electrical signal generated by guitar 102*a*.

In an illustrative embodiment, tone control 234 includes a potentiometer used to select a tone for the electrical signal generated by guitar 102*a*. In an illustrative embodiment, tone control 234 may provide a selection among a specified number of values. For example, tone control 234 may provide a selection from among eight values. A set of tone parameters may be associated with each of the eight values. As an example, the set of tone parameters may include an input trim value, an output trim value, and a frequency, gain, and Q value defined for six frequency bands.

In an illustrative embodiment, depressing tone control 234 and holding tone control 234 in the depressed position converts tone control 234 into a function control. If tone control 234 is rotated, a next function setting is selected. Example functions may include changing the plurality of strings 206, setting an intonation of guitar 102*a*, etc.

In an illustrative embodiment, master control knob 230 includes an eleven position rotary knob that works in conjunction with switch 236. Master control knob 230 may also function as a display indicating the state of guitar 102*a*. For example, once the tuning of guitar 102*a* has finished, a tuning peg symbol on master control knob 230 flashes green to indicate that tuning is complete. In an illustrative embodiment, switch 236 is a five position switch though a fewer or a greater number of switch positions may be used in alternative embodiments. The 55 setting combinations of master control knob 230 and switch may be associated with sound presets or patches and/or additional pickup mode settings.

A user selects a switch position of the five switch positions by sliding slider knob 242 within slider slot 244. When switch 236 is switched, the last preset setting for that switch setting is retrieved regardless of a position of master control knob 230. If master control knob 230 is rotated, a next preset in the selected bank associated with that switch setting (as defined by switch 236) is selected and becomes the default for that switch position. Each switch position may allow selection of a preset within that bank by rotating master control knob 230 clockwise or counter clockwise through the eleven positions though a fewer or a greater number of positions may be selectable using master control knob 230. Each preset setting recalls every parameter that defines creation of a sound using guitar 102*a*. For example, an entire set of possible effects parameters or sound processing parameters may be associated with each preset setting, which also may be referenced as a patch, and stored in a computer-readable medium.

As an example, the effects parameters or sound processing parameters that define a "sound" associated with a preset setting are stored in a computer-readable medium such as a flash memory in guitar 102*a* in a binary data structure based on the following data structures:

```
typedef struct {
    int          index;
    u32          flags;
    ParamPickup          pickups;
    ParamEq              magneticPeq;
    ParamEq              piezoPeq;
    float        piezoBlend;  // 0.0% to 100.0%
    ParamPrefilter       prefilter;
    ParamNoisegate       noisegate;
    ParamCompressor      compressor;
    ParamSustainer       sustainer;
    ParamDrive           drive;
    ParamDistortion      distortion;
```

-continued

```
  ParamCabinet          cabinet;
  ParamEq               postDistortionPeq;
  float            postDistortionEqWetlevel;
  ParamChorus           chorus;
  ParamPhaser           phaser;
  ParamTremolo          tremolo;
  ParamWahwah           wahwah;
  ParamDelay       delay;
  ParamReverb           reverb;
  ParamEq               postReverbPeq;
  float            toneKnob;      // 0.0% to 100.0%
  float            outputGain;    // 0.0% to 100.0%
} Sound;
/** Pickup, Coilswitching */
typedef struct {
  u32 coil_bridge;
  u32 coil_center;
  u32 coil_neck;
} ParamPickup;
/** Equalizer Band Effect */
typedef struct {
  u32 bypass;
  float inputTrim;
  float outputTrim;
  ParamBand bands[PEQ_BANDS];
} ParamEq;
typedef struct {
  float gain;          // decibels (dB)
  float qValue;        // Q
  float frequency;     // hertz (Hz)
} ParamBand;
/** Pre-filter Effect */
typedef struct {
  u32 bypass;
  u32 type;
  float frequency; // Hz
} ParamPrefilter;
/** Noise Gate Effect */
typedef struct {
  u32 bypass;
  float threshold;     // dB
  float attack;        // milliseconds (msec)
  float hold;          // msec
  float release;       // msec
} ParamNoisegate;
/** Compressor Effect */
typedef struct {
  u32 bypass;
  u32 type;
  float threshold;     // dB
  float response;      // msec
  float wetlevel;      // 0.0% to 100.0%
} ParamCompressor;
/** Drive Effect */
typedef struct {
  u32 bypass;
  u32 type;
  float amount;        // 0.0% to 100.0%
  float frequency;     // Hz
} ParamDrive;
/** Sustainer Effect */
typedef struct {
  u32 bypass;
  float sustain;       // 0.0% to 100.0%
  float release;       // msec
} ParamSustainer;
/** Distortion Effect */
typedef struct {
  u32 bypass;
  u32 type;
  u32 flags;
  float amount;        // 0.0% to 100.0%
  float gain;          // dB
  float wetlevel;      // 0.0% to 100.0%
} ParamDistortion;
/** Cabinet simulator and post-distortion equalizer Effect */
typedef struct {
  u32 bypass;
  u32 type;
```

-continued

```
  ParamBand bands[3];
} ParamCabinet;
/** Modulation (Chorus/Vibrato/Flange) Effect */
typedef struct {
  u32 bypass;
  u32 type;
  float wetlevel;                  // 0.0% to 100.0%
  float delayTimeMilliseconds;     // msec
  float rateHertz;                 // low frequency oscillation (LFO)
                                   rate in Hz
  float depth;              // LFO amplitude in msec
  float feedback;                  // 0.0% to 100.0%
} ParamChorus;
/** Phaser Effect */
typedef struct {
  u32 bypass;
  u32 shape;          // 0 for sine LFO, 1 for triangle
  float minFrequency;
  float maxFrequency;
  float rate;         // LFO rate in Hz
  float depth;        // 0.0% to 100.0%
  float feedback;     // 0.0% to 100.0%
} ParamPhaser;
/** Tremolo Effect */
typedef struct {
  u32 bypass;
  u32 sync;           // sync LFO with chorus
  float rate;         // LFO rate in Hz
  float depth;        // 0.0% to 100.0%
} ParamTremolo;
/** Wah-wah Effect */
typedef struct {
  u32 bypass;
  float frequency;
  float gain;         // dB
  float qValue;
} ParamWahwah;
/** Wah-wah Effect Short */
typedef struct {
  float frequency;        // Hz
} ParamWahwahFrequency;
/** Delay Effect */
typedef struct {
  u32 bypass;
  u32 mode;
  float wetlevel;                 // 0.0% to 100.0%
  float time;                     // msec
  float feedback;                 // 0.0% to 100.0%
  float lowPassFrequency;// Hz
  float modulationRate;           // Hz
  float modulationDepth;          // msec
  float ducking;                  // dB
} ParamDelay;
/** Reverb Effect */
typedef struct {
  u32 bypass;
  u32 type;
  float wetlevel;         // 0.0% to 100.0%
  float ducking;          // dB
  float gating; // dB
  float amount;
  float roomsize;
  ParamDiffuser diffusers[REVERB_DIFFUSER_COUNT];
} ParamReverb;
typedef struct {
  u32 bypass;
  int samples;            // delay line length in samples
  float lowPassFrequency;// Hz
  float feedback;                 // 0.0% to 100.0%
} ParamDiffuser;
```

Thus, a value defined for each effect parameter of a plurality of effects defines a preset setting. In an illustrative embodiment, the plurality of effects which can be defined for a preset setting include a pickup selection, magnetic equalization, piezoelectric equalization, piezoelectric blending, pre-filtering, noise gating, compression, sustain, drive, distortion, cabinet simulation, post-distortion equalization, modulation (chorus, vibrato, flange), phaser, tremolo, wah-wah, delay, reverberation, post reverberation equalization, and output gain. For each effect, there are associated effects parameters that define the characteristics for that effect. For example, the wah-wah effect is defined by a frequency value, a gain value, and a Q value. Because in some situations the only effects parameter of the wah-wah effect that is changed is the frequency value, a separate structure is defined which only defines the frequency to reduce the number of bytes needed to transmit the changed value for the wah-wah effect.

In an illustrative embodiment, audio connector 240 includes a standard ¼ inch guitar output and/or a low-impedance, balanced output circuit. Both electromagnetic and piezoelectric pickup signals may be output through audio connector 240. Audio connector 240 may be a type of tip-ring-sleeve (TRS) connector.

Figure 5:
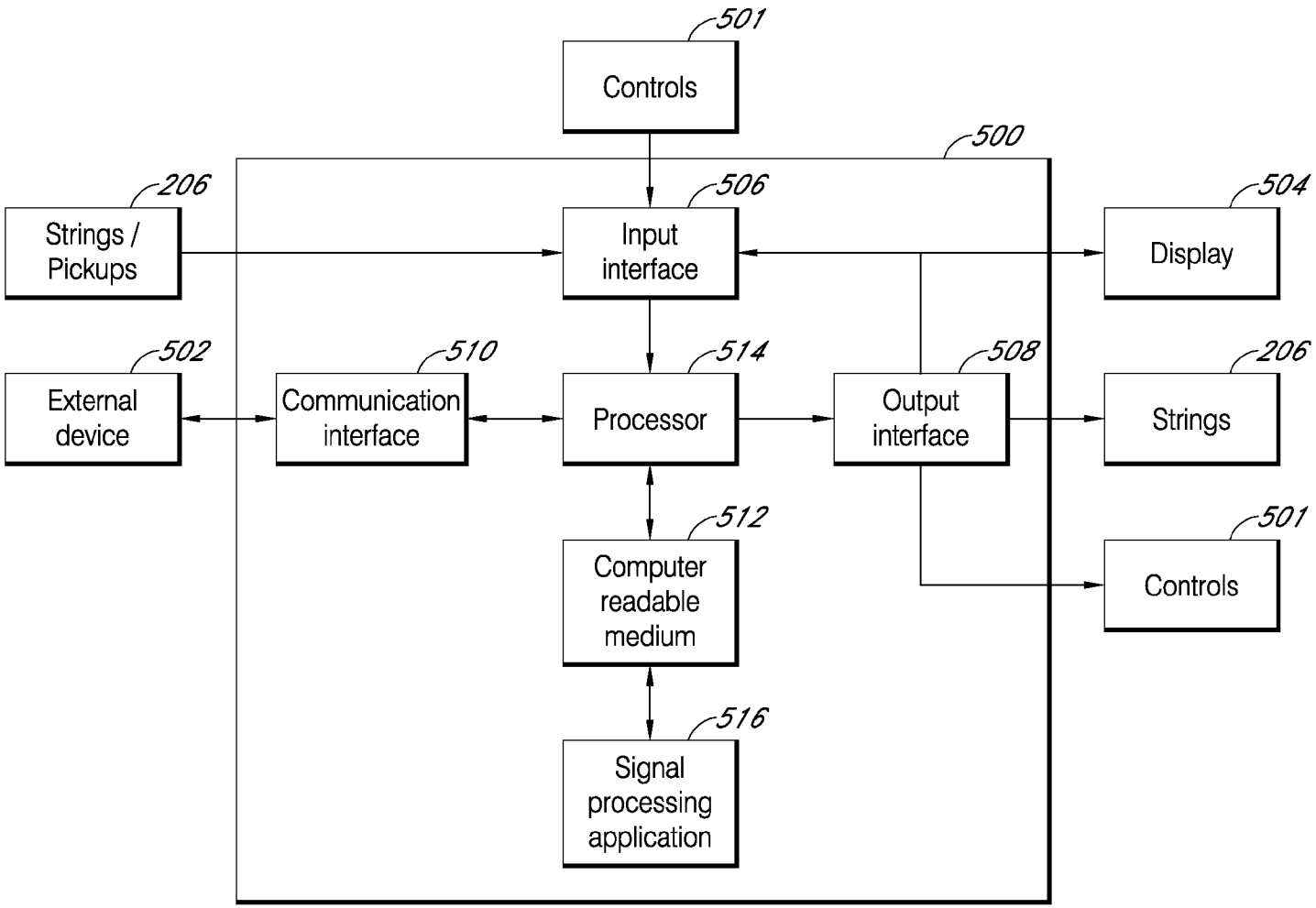
FIG. 5 depicts a block diagram of an electronics module of the guitar of FIG. 2 in accordance with an illustrative embodiment.

With reference to FIG. 5, a block diagram of an electronics module 500 of guitar 102*a* is shown in accordance with an illustrative embodiment. Electronics module 500 may receive signals from the plurality of strings 206, bridge electromagnetic pickup 218, center electromagnetic pickup 220, neck electromagnetic pickup 222, the piezoelectric pickup, controls 501, and/or a display 504 mounted on or within guitar 102*a*. Controls 501 may include the plurality of tuning knobs 210, fader bank 224, tape effect control 226, distortion control 228, master control knob 230, volume control 232, tone control 234, switch 236, and mode control 238. Electronics module 500 also may receive signals from an external device such as any device included in sound system 100.

Electronics module 500 may include an input interface 506, an output interface 508, a communication interface 510, a computer-readable medium 512, a processor 514, and a signal processing application 516. Different and additional components may be incorporated into electronics module 500.

Input interface 506 provides an interface for receiving information into electronics module 500 as known to those skilled in the art. For example, input interface 506 may include an interface to display 504, the plurality of strings 206, controls 501, etc. The same interface may support both input interface 506 and output interface 508. For example, a touch screen both allows user input and presents output to the user. Additionally, an electrical connector may provide both an input interface and an output interface for controls 501. Electronics module 500 may have one or more input interfaces that use the same or a different input interface technology.

Output interface 508 provides an interface for sending information from electronics module 500 to other components of guitar 102*a*. For example, output interface 508 may include an interface to display 504, the plurality of strings 206, controls 501, etc. Display 504 may be a thin film transistor display, a light emitting diode display, a liquid crystal display, or any of a variety of different displays known to those skilled in the art. Electronics module 500 may have one or more output interfaces that use the same or a different interface technology.

In an illustrative embodiment, the positions of controls 501 are not changed by processor 514 through output interface 508. Instead, processor 514 receives a control position from a control of the controls 501 and uses that position to adjust the setting of the effect associated with the control. Thus, a state of the control as stored in computer-readable medium 512 and accessible by processor 514 is updated based on the change and subsequent movement of the control is relative to this new state. The state of the control may be defined and/or updated by an external device using communication interface 510.

Communication interface 510 provides an interface for receiving and transmitting data between devices using various protocols, transmission technologies, and transmission medium as known to those skilled in the art. Communication interface 510 may support communication using various transmission media that may be wired or wireless. Electronics module 500 may have one or more communication interfaces that use the same or a different communication interface technology. For example, electronics module 500 may include a first communication interface to a wired transmission medium and a second communication interface to a wireless transmission medium. Data and/or messages may be transferred between electronics module 500 and external device 502 using communication interface 510.

Computer-readable medium 512 is an electronic holding place or storage for information so that the information can be accessed by processor 514 as known to those skilled in the art. Computer-readable medium 512 can include, but is not limited to, any type of random access memory (RAM), any type of read only memory (ROM), any type of flash memory, etc. such as magnetic storage devices (e.g., hard disk, floppy disk, magnetic strips, secure digital (SD) cards, . . . ), optical disks (e.g., compact disc (CD), digital versatile disc (DVD), . . . ), smart cards, flash memory devices, etc. Electronics module 500 may have one or more computer-readable media that use the same or a different memory media technology. Electronics module 500 also may have one or more drives that support the loading of a memory media such as a CD, DVD, or SD card.

Processor 514 executes instructions as known to those skilled in the art. Processor 514 may be implemented in hardware, firmware, or any combination of these methods and/or in combination with software. The term "execution" is the process of running an application or the carrying out of the operation called for by an instruction. The instructions may be written using one or more programming language, scripting language, assembly language, etc. Processor 514 executes an instruction, meaning that it performs/controls the operation called for by that instruction. Processor 514 operably couples with input interface 506, with output interface 508, with communication interface 510, and with computer-readable medium 512, to receive, to send, and to process information. Processor 514 may retrieve a set of instructions from a permanent memory device and copy the instructions in an executable form to a temporary memory device that is generally some form of RAM. Electronics module 500 may include a plurality of processors that use the same or a different processing technology.

Signal processing application 516 performs operations associated with processing electrical signals received from the plurality of strings 206, bridge electromagnetic pickup 218, center electromagnetic pickup 220, neck electromagnetic pickup 222, and the piezoelectric pickup based on the settings associated with each control of controls 501 and other sound processing parameters stored in computer-readable medium 512. Some or all of the operations described herein may be embodied in signal processing application 516. The operations may be implemented using hardware, firmware, software, or any combination of these methods. With reference to the example embodiment of FIG. 5, signal processing application 516 is implemented in software (comprised of computer-readable and/or computer-executable instructions) stored in computer-readable medium 512 and accessible by processor 514 for execution of the instructions that embody the operations of signal processing application 516. Signal processing application 516 may be written using one or more programming languages, assembly languages, scripting languages, etc.

Figure 6:
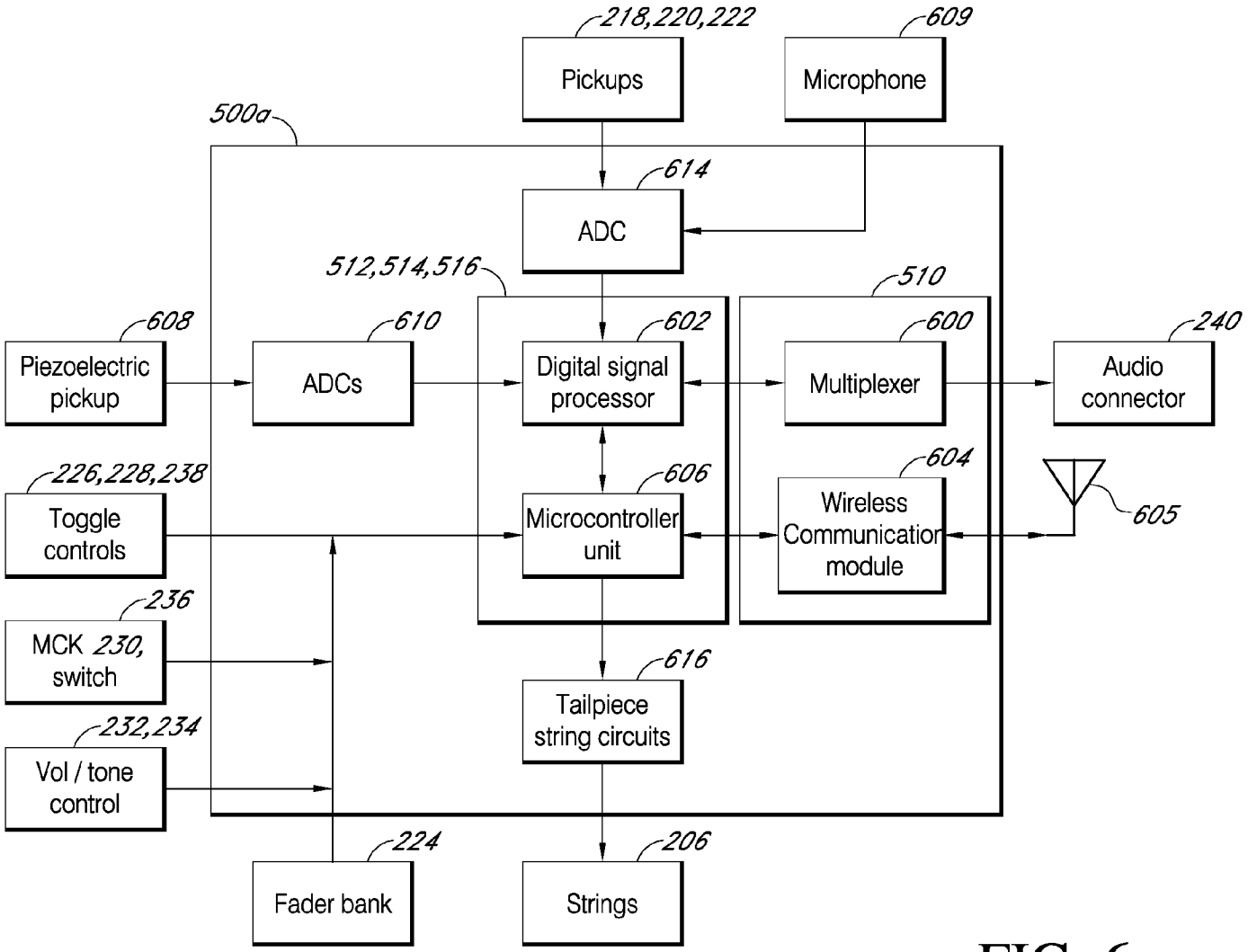
FIG. 6 depicts a more detailed block diagram of the electronics module of FIG. 5 in accordance with an illustrative embodiment.

With reference to FIG. 6, a block diagram of an electronics module 500*a* of guitar 102*a* is shown in accordance with an illustrative embodiment. Electronics module 500*a* may include a multiplexer 600, a digital signal processor (DSP) 602, a wireless communication module 604, a microcontroller unit (MCU) 606, a plurality of analog-to-digital converters (ADCs) 610, an ADC 614, and a tailpiece string circuit 616. Different and additional components may be incorporated into electronics module 500*a*.

Multiplexer 600 and wireless communication module 604 are example communication interfaces 510. Multiplexer 600 receives signals in an analog or in a Sony/Philips digital interconnect format (SPDIF) from DSP 602 and outputs the signals to audio connector 240. Though not shown with reference to FIG. 6, multiplexer 600 may receive a piezoelectric signal generated by a piezoelectric pickup 608 for each of the plurality of strings 206 and/or signals generated by bridge electromagnetic pickup 218, center electromagnetic pickup 220, and/or neck electromagnetic pickup 222. As an example, bridge electromagnetic pickup 218, center electromagnetic pickup 220, and/or neck electromagnetic pickup 222 may generate a signal from each end of each coil of the pickup. For a humbucker pickup, each pickup may generate four signals. In an illustrative embodiment, audio connector 240 can function as a mono, a balanced analog output, a stereo, an unbalanced analog output, or as a full duplex SPDIF input and output.

As shown with reference to FIG. 6, the analog piezoelectric signals generated by piezoelectric pickup 608 may be input to ADCs 610, which convert the analog signal to a digital signal. The resulting digital representation of the piezoelectric signals generated by piezoelectric pickup 608 may be input to DSP 602 for processing. The analog magnetic pickup signals generated by bridge electromagnetic pickup 218, center electromagnetic pickup 220, and/or neck electromagnetic pickup 222 may be combined and input to ADC 614. The resulting digital representation of the combined analog magnetic pickup signals may be input to DSP 602 for processing. The analog microphone signal generated by a microphone 609 may be input to ADC 614. The resulting digital representation of the analog microphone signal may be input to DSP 602 for processing.

In an illustrative embodiment, control inputs from guitar 102*a*, including fader bank 224, tape effect control 226, distortion control 228, master control knob 230, volume control 232, tone control 234, switch 236, and mode control 238, are input to MCU 606. MCU 606 may be configured to output signals to tailpiece string circuits 616 to control a tension on the plurality of strings 206 based on a setting selected by the user using mode control 238 in second position 406.

Figure 7:
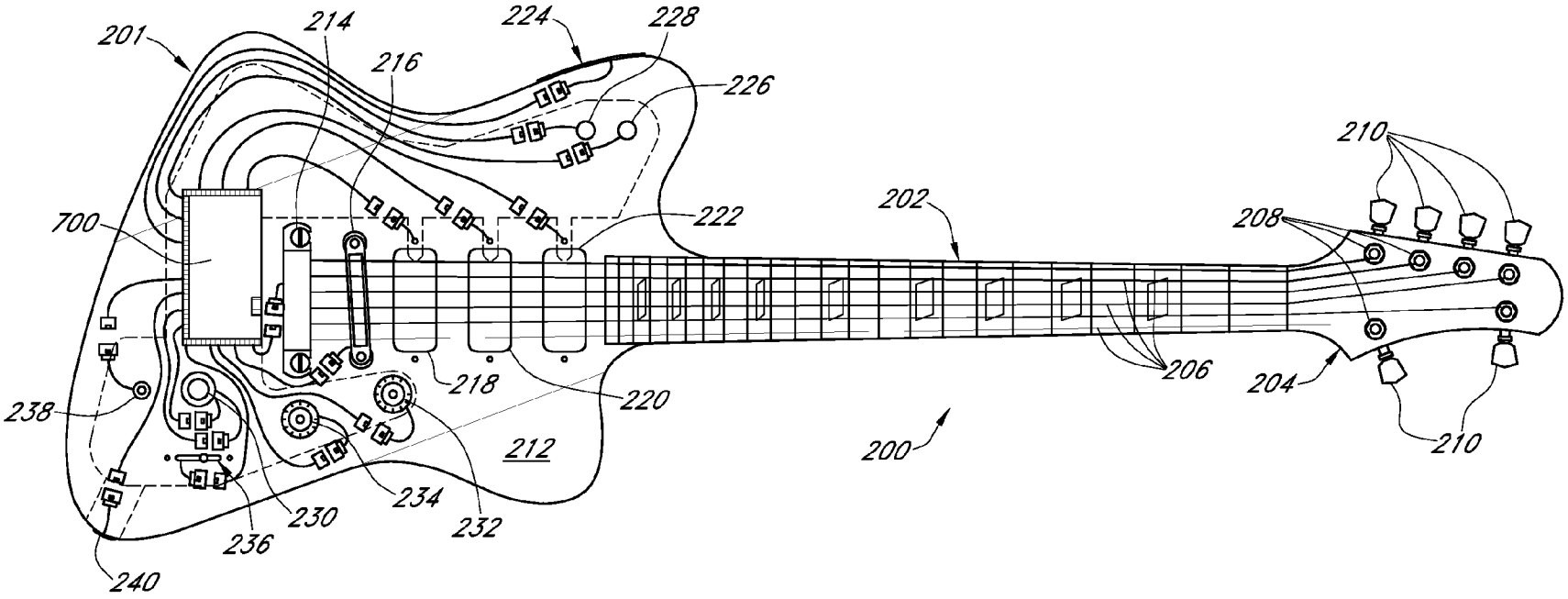
FIG. 7 depicts a top view of the guitar of FIG. 2 illustrating a wiring between a plurality of controls and the electronics module of FIG. 5 in accordance with an illustrative embodiment.

With reference to FIG. 7, a wiring diagram from fader bank 224, tape effect control 226, distortion control 228, master control knob 230, volume control 232, tone control 234, switch 236, mode control 238, bridge electromagnetic pickup 218, center electromagnetic pickup 220, neck electromagnetic pickup 222, and piezoelectric pickup 608 to an adapter 700 coupled to electronics module 500*a* of guitar 102*a* is shown in accordance with an illustrative embodiment. Other wiring arrangements may be defined to connect the elements of guitar 102*a* to electronics module 500*a*. Additionally, fader bank 224, tape effect control 226, distortion control 228, master control knob 230, volume control 232, tone control 234, switch 236, and mode control 238 may be positioned in alternative locations on guitar 102*a*. Some or all of the components of electronics module 500*a* of guitar 102*a* may be replaceable. For example, adapter 700 may be used to allow various guitar designs to be used with electronics module 500*a* and vice versa where adapter 700 includes guitar controls that may not be used in all models, but accommodate various guitar designs. By standardizing a form factor for electronics module 500*a*, higher volumes of production and lower costs can be achieved because the same electronics module 500*a* can be used in many different types and models of guitar.

In an illustrative embodiment, a synchronous serial data link connects MCU 606 to wireless communication module 604 and communicates digital signals in full duplex mode between MCU 606 and wireless communication module 604. Wireless communication module 604 sends and receives signals through an antenna 605 operably coupled to wireless communication module 604 of electronics module 500*a*. Antenna 605 may be configured to send and to receive signals at various frequencies.

A synchronous serial data link also connects MCU 606 to DSP 602 in full duplex mode. MCU 606 and DSP 602 are example processors 514, which include computer-readable medium 512 on which is stored signal processing application 516.

In an illustrative embodiment, DSP 602 is a DSPB56720 multi-core audio processor manufactured by Freescale Semiconductor, Inc. For example, DSP 602 may include two cores, which are synchronously clocked and include parallel processing paths as well as a shared memory space. Both cores may be fixed point, 24-bit processors. Each core may include three separate memory spaces: a P memory for program code and an X memory and a Y memory for data. Each memory space may be addressed separately such that location 0x100 for P memory is a different physical memory location than location 0x100 for X memory. Each core may have a serial peripheral interface (SPI) port through which DSP 602 communicates with MCU 606. In an illustrative embodiment, a plug-in may be installed on DSP 602 to apply effects to the signals generated by the pickups 218, 220, 222, microphone 609, and piezoelectric pickup 608 which are input to DSP 602.

In an illustrative embodiment, MCU 606 is an STM32 ARM Cortex microcontroller unit manufactured by STMicroelectronics with 512 kilobytes of flash memory. MCU 606 can control DSP 602 by sending command packets over the SPI after both cores are loaded with signal processing application 516 as appropriate. In an illustrative embodiment, the command packets sent from MCU 606 to DSP 602 include a header that specifies a category indicator and a command indicator. After receiving a packet, DSP 602 may send a response packet to MCU 606 that indicates a success or failure of the command.

The category indicator may indicate categories such as a system category and an effect category. The system category may be used for general DSP identification and control. The effect category may be used to get or set parameters associated with an effect. For example, a command specifying a get effect category may request the currently set values for the parameters associated with an effect by specifying an effect index to the effect in the command packet. The response packet sent from DSP 602 to MCU 606 includes the currently set values for the effect indicated by the specified effect index. A command specifying a set effect category may request that the parameters associated with an effect be set to values defined in the command packet by specifying the index to the effect and the desired values for the effect parameters.

As an example, a tone setting may be adjusted based on a user selection using tone control 234. A value indicating the user selection and indicating a tone control effect index may be sent in a command packet from MCU 606 to DSP 602 using the SPI and specifying a set effect category. The parameters associated with that tone may be extracted from a lookup table stored in a computer-readable medium 512 of DSP 602. DSP 602 may confirm that the effect index is valid. If the effect index is valid, the effect parameters associated with the effect index are set to the values received in the command packet. Signal processing application 516 uses the effect parameters in subsequent processing of the input signals from bridge electromagnetic pickup 218, center electromagnetic pickup 220, neck electromagnetic pickup 222, and piezoelectric pickup 608.

In an illustrative embodiment, an effect index table as shown below may be implemented where the effect index and associated inputs are sent in a set effect category command packet to change the values of the parameters associated with the effect so that DSP 602 utilizes these values in subsequent signal processing:

| Effect Index | Effect description | Inputs |
|---|---|---|
| 0 | Piezoelectric pickup six channel mixer | A gain value for each string. |
| 1 | Parametric equalizer for electromagnetic pickups | Filter coefficients for a low band, low-mid band, high-mid band, and high band calculated for a six band parametric equalizer based on a gain value, a Q value, and a frequency value defined for each band, and an input trim value and an output trim value defined for the equalizer. In an alternative embodiment, the six band parametric equalizer inputs including a gain value, a Q value, and a frequency value defined for each band, and an input trim value and an output trim value defined for the equalizer may be input and the filter coefficients calculated by DSP 602. |
| 2 | Parametric equalizer for piezoelectric pickup | Filter coefficients for a low band, low-mid band, high-mid band, and high band calculated for a six band parametric equalizer based on a gain value, a Q value, and a frequency value defined for each band, and an input trim value and an output trim value defined for the equalizer. In an alternative embodiment, the six band parametric equalizer inputs including a gain value, a Q value, and a frequency value defined for each band, and an input trim value and an output trim value defined for the equalizer may be input and the filter coefficients calculated by DSP 602. |
| 3 | Piezoelectric pickup blend mixer | A piezoelectric gain value. |
| 4 | Prefilter | High-pass filter coefficients calculated based on a filter type (e.g., five types selected from: flat, low bump, vintage1, vintage2, vintage3) and a low cut frequency value. |
| 5 | Noise gate | A threshold value, a hold time constant value, an attack time constant value, and a release time constant value. |
| 6 | Compressor | A threshold value, an attack time constant value, a release time constant value, and a compression table created based on the setting of the threshold value and a compression amount selected based on a type (e.g., three types: 8:1; 4:1; 2:1) value selected. |
| 7 | Drive | Six notch filter coefficients calculated based on a type of drive selected (e.g., nine types: amp1, amp2, amp3, wah, reso lp, active lp, reso hp, active hp, tight wah), an amount value of an amount of drive selected, and a frequency value selected. |
| 8 | Sustain | A sustain time constant, a release time constant, and an attack time constant. |
| 9 | Distortion | A value of a wet level, a threshold value, a makeup gain value, an attack time constant value, a release time constant value, an attack time delta value, low pass filter coefficient values, and a distortion table created based on a distortion amount and a type of distortion selected (e.g., seven types: light, light 2, medium, heavy, shred, screamer, overdrive). |
| 10 | Parametric cabinet equalizer | High pass, peaking band, low/high shelving band, and low pass filter coefficients calculated based on a cabinet type. |
| 11 | Modulation (Chorus/Vibrato/Flanger) | A value of a wet level, a time step value, and a depth value. |
| 12 | Phaser | A value of the minimum frequency, a maximum frequency value, a rate value, a depth value, a feedback value, and a low frequency oscillators shape value. |
| 13 | Tremolo | A value for the rate and a value for the depth. The tremolo can be synchronized with the chorus for a rotating speaker effect. |

-continued

| Effect Index | Effect description | Inputs |
|---|---|---|
| 14 | Wah-wah | A value for the frequency, the value for the Q value, and a value to enable or disable the wah-wah. |
| 15 | Delay | A value of a wet level, a time sample value, a delay feedback gain value, a low pass filtering frequency value, a modulation rate value, a modulation depth value, and a ducking value that automatically reduces the volume of the effect while guitar 102a is played. In an illustrative embodiment, guitar 102a automatically detects a tempo while being played and sets the delay time accordingly if a "tap tempo" mode is selected for guitar 102a. |
| 16 | Reverb | A value of a wet level, a ducking level, a gating level, and individual feedback, delay time, and low pass frequency values for each of eight diffusers. |
| 17 | Final equalizer | Filter coefficients for a low band, low-mid band, high-mid band, and high band calculated for a six band parametric equalizer based on a gain value, a Q value, and a frequency value defined for each band, and an input trim value and an output trim value defined for the equalizer. In an alternative embodiment, the six band parametric equalizer inputs including a gain value, a Q value, and a frequency value defined for each band, and an input trim value and an output trim value defined for the equalizer may be input and the filter coefficients calculated by DSP 602. |
| 18 | Tone control | A value indicating a selection using tone control 234. |
| 19 | Output gain | A gain value. |

A fewer or a greater number of effects may be defined in any order. An effect may be turned off using a bypass setting for that effect index. Additionally, an input from a control received by MCU 606 may be used to calculate an effects parameter input to DSP 602. For example, the distortion table may be defined based on a distortion amount and a type of distortion selected using distortion control 228 positioned in first position 404 and first fader control 304 and second fader control.

The effects associated with a single sound combine the settings of all of the effects as currently defined in DSP 602. To update the values associated with each effect, a new value can be set using a command packet sent from MCU 606 as discussed above. The new values may be set by adjusting the controls of guitar 102*a* or based on values received through wireless communication module 604. Additionally, DSP 602 may selectively pass the input signals received from bridge electromagnetic pickup 218, center electromagnetic pickup 220, neck electromagnetic pickup 222, and piezoelectric pickup 608 through to either audio connector 240 and/or wireless communication module 604 without modification.

DSP 602 may store the current effects settings in computer-readable medium 512 of DSP 602. For example, the values of the parameters that define the effects for a single sound may be defined in a lookup table. As each audio input signal is received into DSP 602 based on a clock cycle, the effects are successively applied to the input signal using signal processing application 516 to form an output signal that may be communicated to multiplexer 600 and audio connector 240 to external device 502 or to MCU 606 and wireless communication module 604 to external device 502.

Figure 8:
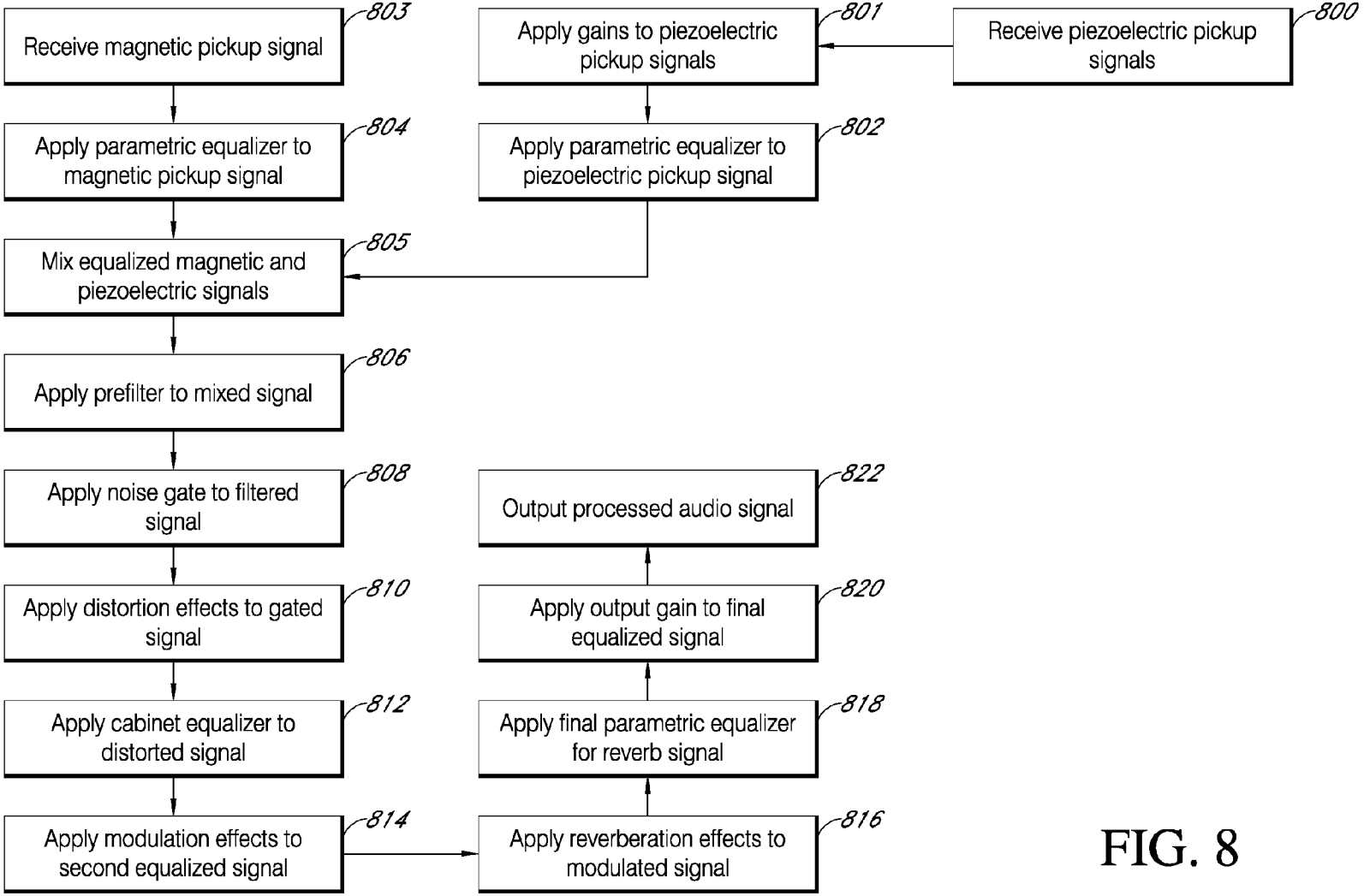
FIG. 8 depicts a flow diagram illustrating example operations performed by the electronics module of FIG. 5 in accordance with an illustrative embodiment.

With reference to FIG. 8, example operations associated with signal processing application 516 are described. Additional, fewer, or different operations may be performed depending on the embodiment. The order of presentation of the operations of FIG. 8 is not intended to be limiting. Thus, although some of the operational flows are presented in sequence, the various operations may be performed in various repetitions, concurrently, and/or in other orders than those that are illustrated. In an operation 800, piezoelectric signals are received from piezoelectric pickup 608. As shown with reference to FIG. 6, the piezoelectric signals may be received in digital form after processing through ADCs 610.

With continuing reference to FIG. 8, in an operation 801, a gain value defined for each string of the plurality of strings 206 is applied, for example, using a six channel mixer. Of course, if guitar 102*a* includes a greater or a fewer number of strings of the plurality of strings 206, the mixer may include a greater or a fewer number of channels. In an operation 802, the filter coefficients for the six band parametric equalizer, the input trim value, and the output trim value defined for piezoelectric pickup 608 are applied to the mixed piezoelectric signal.

In an operation 803, an electromagnetic pickup signal is received from bridge electromagnetic pickup 218, center electromagnetic pickup 220, and neck electromagnetic pickup 222. As shown with reference to FIG. 6, the electromagnetic pickup signal may be received in digital form after processing through ADC 614. Additionally, the received electromagnetic pickup signal may be combined from bridge electromagnetic pickup 218, center electromagnetic pickup 220, and neck electromagnetic pickup 222 using a mixer. In an operation 804, the filter coefficients for the six band parametric equalizer, the input trim value, and the output trim value defined for the electromagnetic pickups 218, 220, 222 are applied to the received electromagnetic pickup signal.

In an operation 805, the equalized electromagnetic and piezoelectric signals are mixed based on the piezoelectric gain value. The electromagnetic pickup gain is automatically calculated as 1.0—the piezoelectric gain value. Thus, if the piezoelectric gain value is input as 0.75, the electromagnetic gain is set to 0.25.

In an operation 806, the high-pass filter coefficients calculated based on the prefilter type (e.g., five types selected from: flat, low bump, vintage1, vintage2, vintage3) and the low cut frequency value are applied to the mixed signal to remove unwanted direct current (DC) and similar noise from the mixed signal. In an operation 808, the noise gate controls are applied to the filtered signal to minimize the amount of noise heard at the output. The noise gate controls automatically reduce input gain to zero when the mixed signal drops below the selected noise gate threshold. The attack, hold, and release time constant values allow the noise gate to open and close in a way that does not interfere with the generated sound.

In an operation 810, distortion effects are applied to the noise gated signal. For example, the compressor, sustainer, drive, and distortion control settings are applied to the noise gated signal. The combination of the compressor and sustainer create a gain-slew affect common to many amplifiers when operated at high volume levels. The amplifier attempts to restrict output levels at a maximum, while boosting lower levels to the desired gain. The compressor and sustainer can also achieve long sustained sounds, while reducing the transient signal levels (e.g., initial string plucks). The drive control articulates the color of the distortion, allowing the selection of the portion of the frequency spectrum incurring more distortion.

In an operation 812, the high pass, peaking band, low/high shelving band, and low pass filter coefficients defined for the parametric cabinet equalizer based on a cabinet type are applied to the distorted signal. In an operation 814, modulation effects are applied to the second equalized signal output based on the parametric cabinet equalizer effect settings. For example, chorus/vibrato/flanger, phaser, tremolo, wah-wah, and delay control settings are applied to the second equalized signal. In an operation 816, reverberation effects settings are applied to the modulated signal. In an operation 818, the final parametric equalizer is applied to the reverb signal. In an operation 820, the output gain is applied to the final equalized signal.

In an operation 822, the processed audio signal is output from DSP 602 to multiplexer 600 and audio connector 240 to external device 502 or to MCU 606 and wireless communication module 604 to external device 502. The processed audio signal may be transmitted in a digital form. The same effects settings are applied to the received piezoelectric and electromagnetic pickup signals until DSP 602 receives a set effect category command from MCU 606 which updates the specified effect settings. The updated effects settings are applied to successive pickup signals. Transmission of a set effect category command from MCU 606 to DSP 602 may be triggered by user adjustment of one or more of fader bank 224, tape effect control 226, distortion control 228, master control knob 230, volume control 232, tone control 234, switch 236, and mode control 238. Additionally, transmission of a set effect category command from MCU 606 to DSP 602 may be triggered by receipt of a control signal through wireless communication module 604 from external device 502.

The command indicator may indicate a type of system command. Example types of system commands may include an identification command, a get version command, a read DSP memory command, and a write DSP memory command. An identification command may be used to confirm that DSP 602 is loaded and running. If properly loaded and running, DSP 602 may return a known value in the response packet. A get version command may be used to determine a version number of signal processing application 516. DSP 602 may return a version number of signal processing application 516 in the response packet. A read DSP memory command may be used to read one or more words from computer-readable medium 512 of DSP 602.

The command packet may include an indication of the core, an indication of the memory space, an address, and a number of words to read from DSP 602. DSP 602 may return a variable length packet, depending on the number of words to read, that includes the value(s) stored at the requested address of the requested memory space for the requested core. A write DSP memory command includes an indication of the core, an indication of the memory space, an address, a number of words to read from DSP 602, and the values to store at the requested address of the requested memory space for the requested core. DSP 602 may return a response packet that indicates the success or failure of the write DSP memory command.

In an illustrative embodiment, wireless communication module 604 is a Bluetooth system that implements a communication protocol based on the Bluetooth protocol to connect with some or all external devices 502. Bluetooth is a packet-based protocol with a master-slave structure that partitions a signal to be transmitted into segments. Two signals may be overlaid on each other. In an illustrative embodiment, a first signal includes an audio stream from guitar 102*a*. The audio stream may be the processed audio signal output from DSP 602 and transmitted from antenna 605. In an illustrative embodiment, the audio stream is sent directly to wireless communication module 604 from DSP 602 using an integrated interchip Sound (I2S) digital interface connection.

A second signal includes program and musical instrument digital interface (MIDI) control messages which are sent to devices paired with guitar 102*a*, which may act like a master device in a piconet established based on the Bluetooth protocol. Thus, network 114 may include a piconet or other ad hoc network. An external device 502 may send Bluetooth packets to guitar 102*a*, which control operation of electronics module 500*a* by defining effects settings. MCU 606 receives the effects and sends the effect values to DSP 602 in a command packet as described previously. Additionally, control parameters of guitar 102*a* may be displayed on external device 502. In an illustrative embodiment, the communication of packets between devices is supported using a time division multiplexing scheme where the devices paired with guitar 102*a* are synchronized in time.

When guitar 102*a* is not connected to network 114, wireless communication module 604 periodically listens for messages from external device 502. As an example, when external device 502 is switched on, wireless external device 502 automatically initiates an inquiry to find guitar 102*a*. Guitar 102*a* responds with its address. Guitar 102*a* may be configured to respond only when placed in a pairing mode using a control of the controls 501. In an illustrative embodiment, an extended inquiry response (EIR) method is used to read a company identifier and the device address. The company identifier may be used to recognize other devices appropriate for communicating wirelessly with guitar 102*a*.

The device address field is established for both a sending and a receiving device in the established piconet which may form all or a part of network 114. Part of the device address field may be used to define the type of device while a second part of the device address field may be used to define an instance of the device type to allow multiple devices of the same type to be included in network 114. In an illustrative embodiment, the address field may further indicate a component of guitar 102*a* which receives the packet. For example, if guitar 102*a* includes a plurality of processors, each processor 514 may addressed separately.

In an illustrative embodiment, the second part of the address field used to define an instance of the device type may be a random code generated by the device. For example, a three-digit code may be defined using [A-Z][0-9] resulting in 46,656 possible codes. As a result, it is unlikely that different devices generate the same code. The resulting code for guitar 102*a* may be displayed on master control knob 230 for reference by a user.

After receiving the address from guitar 102*a*, a paging procedure is executed to synchronize external device 502 with guitar 102*a*. Packet exchange is based on a master clock with the master transmitting in specified time slots and the slave device(s) (external device 502) transmitting in other assigned time slots. A link is established between external device 502 and guitar 102*a* and information related to the services available from external device 502 and guitar 102*a* is exchanged. Standard network protocols may be used to send and receive data.

In an illustrative embodiment, guitar 102*a* is turned on and the three-digit code of guitar 102*a* is displayed on master control knob 230 where the master control knob 230 is switched to a setup function. A second device, such as a footswitch controller of the one or more footswitch controllers 106 is switched on and a setup function is entered to initiate a pairing function between guitar 102*a* and the footswitch controller. All devices with the specified company identifier may be listed on a display associated with each footswitch controller of the one or more footswitch controllers 106. The device name of guitar 102*a* may be selected from the display, for example, using up/down buttons to highlight the device name of guitar 102*a* and pressing an "Enter" button. Of course, other devices including additional guitars of the one or more guitars 102, one or more amplifiers 104, one or more interface devices 108, and one or more computing devices may be similarly paired with guitar 102*a*.

In an illustrative embodiment, guitar 102*a* and the paired devices may store the appropriate device identifiers into computer-readable medium 512 of MCU 606 and/or DSP 602 to automatically re-establish a connection between the devices when each device is turned on. A user may pair some devices with a first guitar of the one or more guitars 102 while pairing a different set of devices with a second guitar of the one or more guitars 102, whereas some devices may be paired with multiple guitars of the one or more guitars 102 depending on the desired configuration of network 114.

As known to a person of skill in the art, a packet sent to/from guitar 102*a* may include a header portion and a data portion. A cyclic redundancy check (CRC) may be applied to the header and/or to the entire packet to insure proper receipt of the packet. For example, the packet may include a first CRC value calculated for the header portion of the packet and a second CRC value calculated for the entire packet. The header portion may include a start sign field, a need acknowledge flag, a packet number field, a contains acknowledge flag, a packet number field of the packet acknowledged, a version number field, a sender address field, a receiver address field, a number of bytes field, and a category identifier field used to identify a type of packet. The start sign field includes a start sign that indicates the start of the packet. The need acknowledge flag indicates that the sending device is requesting an acknowledgement packet from the receiving device. If the sending device does not receive a packet including an acknowledgement of the packet within a specified time period, the sending device resends the packet.

The packet number field indicates the packet number of the current packet. The packet number may be synchronized between all devices communicating using wireless communication module 604. If a first device sends a packet with packet number 0, a second device answers with packet number 1. A third device tracks the communication between the first device and the second device and then uses packet number 2. Thus, sending and receiving increments the packet number for all communicating devices. The packet numbers may restart at zero when a maximum value is reached, for example, based on a number of bytes of the packet number field.

The contains acknowledge flag indicates whether or not the packet includes an acknowledgement for a previously received packet. The packet number field of the packet acknowledged indicates the packet number of the packet being acknowledged in the current packet. When a packet is received, the receiving device waits a timeout period if an acknowledgement is to be sent based on the setting of the need acknowledge flag. If another packet is being sent, the acknowledge is put into the header of the packet by setting the contains acknowledge flag and packet number field indicating the packet number of the packet acknowledged. If another packet is not being sent, an empty packet is generated containing the acknowledgment.

The version number field indicates the version of the header definition of the current packet. The sender address field includes the address of the device sending the current packet. The receiver address field includes the address of the device intended to receive the current packet. Other devices receiving the packet may ignore the packet. The number of bytes field indicates the number of bytes included in the data portion of the current packet.

The category identifier field identifies the type of packet. For example, a category identifier may indicate the packet includes a system command, an update command, a sound control command, a real-time control command, a configuration command, or a patch exchange command. The system command, for example, may request a version number or include a ping command to determine if the receiving device is active. A system command may include a command type indicator and any data associated with the command. Command type indicators may indicate an empty packet that includes an acknowledgment of a previously received packet, a ping command, and a reply to a ping command.

The update command may include a binary package to update the receiving device. For example, the binary package may be used to update signal processing application 516 executed at MCU 606 and/or DSP 602 of guitar 102*a*. The real-time control command request may include settings for real-time changes, message displaying, and mode control of the receiving device. The configuration command may include configuration and setup function requests to/from the receiving device.

The sound control command may include a command type indicator and any data associated with the command type. Command type indicators may indicate a request to change one or more sound effects parameters in the receiving device, a request to read a value of one or more sound effects parameters at the receiving device, and an answer including the requested value of the one or more sound effects parameters at the receiving device. Thus, guitar 102*a* and external device 502 may exchange effects settings.

A packet including a command indicating a request to change one or more sound effects parameters may include the need acknowledge flag set to require an acknowledgement and any number of sound effects parameters. Each sound effects parameter is indicated using a unique effects identifier key and a corresponding effects value for that effect. The unique effects identifier key is uniquely assigned to each effects parameter. The value for each effect may be a predefined number of bits so that if the unique effects identifier key is not recognized by the receiving device, the subsequent predefined number of bits can be ignored. The values additionally may be represented with the same units for all devices.

A packet including a command indicating a request to read a value of one or more sound effects parameters at the receiving device may include one or more unique effects identifier keys associated with the effects parameters for which a value is requested. A packet including a command indicating an answer to the request includes the contains acknowledge flag set and the packet number of the packet requesting the sound effects values. The packet further includes the number of sound effects parameters identified in the request. Each sound effects parameter is indicated using the unique effects identifier key and the corresponding effects value for that effect.

The sound control command further may include a request to upload/download all or some of the sounds effects parameters associated with a sound patch without changing the current effects settings. The sound control command may include a command type indicator, any data associated with the command type, and a patch identifier. The patch identifier uniquely identifies the patch. Command type indicators may indicate a request to change one or more sound effects parameters associated with identified sound patch, a request to read a value of one or more sound effects parameters associated with identified sound patch, and an answer including the requested value of the one or more sound effects parameters associated with identified sound patch. Thus, guitar 102*a* and external device 502 may exchange/update patch definitions. In an illustrative embodiment, a patch is stored in computer-readable medium 512 of guitar 102*a* in an extensible binary data structure.

A packet including a command indicating a request to change one or more sound effects parameters in a patch may include the need acknowledge flag set to require an acknowledgement and any number of sound effects parameters. Each sound effects parameter is indicated using a unique effects identifier key and a corresponding effects value for that effect. A packet including a command indicating a request to read a value of one or more sound effects parameters of a patch may include one or more unique effects identifier keys associated with the effects parameters for which a value is requested. A packet including a command indicating an answer to the request includes the contains acknowledge flag set and the packet number of the packet requesting the sound effects values. The packet further includes the number of sound effects parameters identified in the request. Each sound effects parameter is indicated using the unique effects identifier key and the corresponding effects value for that effect.

An example set of sound effects parameters and associated unique keys is shown in the table below with the unit type for the sound effect parameter.

| Name | Unique Key | Unit |
|---|---|---|
| PEQ_MAG_BYPASS | 0x000000 | ENUM |
| PEQ_MAG_0_GAIN | 0x000010 | dB |
| PEQ_MAG_1_GAIN | 0x000011 | dB |
| PEQ_MAG_2_GAIN | 0x000012 | dB |
| PEQ_MAG_3_GAIN | 0x000013 | dB |
| PEQ_MAG_4_GAIN | 0x000014 | dB |
| PEQ_MAG_5_GAIN | 0x000015 | dB |
| PEQ_MAG_0_Q | 0x000020 | Value |
| PEQ_MAG_1_Q | 0x000021 | Value |
| PEQ_MAG_2_Q | 0x000022 | Value |
| PEQ_MAG_3_Q | 0x000023 | Value |
| PEQ_MAG_4_Q | 0x000024 | Value |
| PEQ_MAG_5_Q | 0x000025 | Value |
| PEQ_MAG_0_FREQ | 0x000030 | Hz |

-continued

| Name | Unique Key | Unit |
|---|---|---|
| PEQ_MAG_1_FREQ | 0x000031 | Hz |
| PEQ_MAG_2_FREQ | 0x000032 | Hz |
| PEQ_MAG_3_FREQ | 0x000033 | Hz |
| PEQ_MAG_4_FREQ | 0x000034 | Hz |
| PEQ_MAG_5_FREQ | 0x000035 | Hz |
| PEQ_PIEZO_BYPASS | 0x000100 | ENUM |
| PEQ_PIEZO_0_GAIN | 0x000110 | dB |
| PEQ_PIEZO_1_GAIN | 0x000111 | dB |
| PEQ_PIEZO_2_GAIN | 0x000112 | dB |
| PEQ_PIEZO_3_GAIN | 0x000113 | dB |
| PEQ_PIEZO_4_GAIN | 0x000114 | dB |
| PEQ_PIEZO_5_GAIN | 0x000115 | dB |
| PEQ_PIEZO_0_Q | 0x000120 | Value |
| PEQ_PIEZO_1_Q | 0x000121 | Value |
| PEQ_PIEZO_2_Q | 0x000122 | Value |
| PEQ_PIEZO_3_Q | 0x000123 | Value |
| PEQ_PIEZO_4_Q | 0x000124 | Value |
| PEQ_PIEZO_5_Q | 0x000125 | Value |
| PEQ_PIEZO_0_FREQ | 0x000130 | Hz |
| PEQ_PIEZO_1_FREQ | 0x000131 | Hz |
| PEQ_PIEZO_2_FREQ | 0x000132 | Hz |
| PEQ_PIEZO_3_FREQ | 0x000133 | Hz |
| PEQ_PIEZO_4_FREQ | 0x000134 | Hz |
| PEQ_PIEZO_5_FREQ | 0x000135 | Hz |
| PREFILTER_BYPASS | 0x000200 | ENUM |
| PREFILTER_TYPE | 0x000201 | ENUM |
| PREFILTER_FREQ | 0x000202 | Hz |
| NOISEGATE_BYPASS | 0X000300 | ENUM |
| NOISEGATE_THRESHOLD | 0x000300 | dB |
| NOISEGATE_ATTACK | 0x000301 | ms |
| NOISEGATE_HOLD | 0x000302 | ms |
| NOISEGATE_RELEASE | 0x000303 | ms |
| COMPRESSOR_BYPASS | 0x000400 | ENUM |
| COMPRESSOR_TYPE | 0x000401 | ENUM |
| COMPRESSOR_THRESHOLD | 0x000402 | dB |
| COMPRESSOR_RESPONSE | 0x000403 | Value |
| COMPRESSOR_WETLEVEL | 0x000404 | Value |
| DRIVE_BYPASS | 0x000500 | ENUM |
| DRIVE_TYPE | 0x000501 | ENUM |
| DRIVE_AMOUNT | 0x000502 | Value |
| DRIVE_FREQUENCY | 0x000503 | Hz |
| DRIVE_BITE | 0x000504 | Value |
| SUSTAINER_BYPASS | 0x000600 | ENUM |
| SUSTAINER_SUSTAIN | 0x000601 | Value |
| SUSTAINER_RELEASE | 0x000602 | Value |
| DISTORTION_BYPASS | 0x000603 | ENUM |
| DISTORTION_TYPE | 0x000604 | ENUM |
| DISTORTION_AMOUNT | 0x000605 | Value |
| DISTORTION_GAIN | 0x000606 | dB |
| DISTORTION_WET_LEVEL | 0x000607 | Value |
| CABINET_BYPASS | 0x000700 | ENUM |
| CABINET_TYPE | 0x000701 | ENUM |
| CABINET_BAND_0_GAIN | 0x000710 | dB |
| CABINET_BAND_1_GAIN | 0x000711 | dB |
| CABINET_BAND_2_GAIN | 0x000712 | dB |
| CABINET_BAND_0_Q | 0x000720 | Value |
| CABINET_BAND_1_Q | 0x000721 | Value |
| CABINET_BAND_2_Q | 0x000722 | Value |
| CABINET_BAND_0_FREQ | 0x000730 | Hz |
| CABINET_BAND_1_FREQ | 0x000731 | Hz |
| CABINET_BAND_2_FREQ | 0x000732 | Hz |
| POST_DISTORTION_EQ_WETLEVEL | 0x000800 | Value |
| CHORUS_BYPASS | 0x000900 | ENUM |
| CHORUS_WET_LEVEL | 0x000901 | Value |
| CHORUS_RATE | 0x000902 | Value |
| CHORUS_DEPTH | 0x000903 | Value |
| CHORUS_TYPE | 0x000904 | ENUM |
| DELAY_BYPASS | 0x000A00 | ENUM |
| DELAY_WET_LEVEL | 0x000A01 | Value |
| DELAY_TIME | 0x000A02 | Value |
| DELAY_FEEDBACK | 0x000A03 | Value |
| REVERB_BYPASS | 0x000B00 | ENUM |
| REVERB_TYPE | 0x000B01 | ENUM |
| REVERB_WET_LEVEL | 0x000B02 | Value |
| REVERB_AMOUNT | 0x000B03 | Value |
| REVERB_ROOMSIZE | 0x000B04 | Value |
| REVERB_TONE | 0x000B05 | |

-continued

| Name | Unique Key | Unit |
|---|---|---|
| PEQ_POSTREV_BYPASS | 0x000C00 | ENUM |
| PEQ_POSTREV_0_GAIN | 0x000C10 | dB |
| PEQ_POSTREV_1_GAIN | 0x000C11 | dB |
| PEQ_POSTREV_2_GAIN | 0x000C12 | dB |
| PEQ_POSTREV_3_GAIN | 0x000C13 | dB |
| PEQ_POSTREV_4_GAIN | 0x000C14 | dB |
| PEQ_POSTREV_5_GAIN | 0x000C15 | dB |
| PEQ_POSTREV_0_Q | 0x000C20 | Value |
| PEQ_POSTREV_1_Q | 0x000C21 | Value |
| PEQ_POSTREV_2_Q | 0x000C22 | Value |
| PEQ_POSTREV_3_Q | 0x000C23 | Value |
| PEQ_POSTREV_4_Q | 0x000C24 | Value |
| PEQ_POSTREV_5_Q | 0x000C25 | Value |
| PEQ_POSTREV_0_FREQ | 0x000C30 | Hz |
| PEQ_POSTREV_1_FREQ | 0x000C31 | Hz |
| PEQ_POSTREV_2_FREQ | 0x000C32 | Hz |
| PEQ_POSTREV_3_FREQ | 0x000C33 | Hz |
| PEQ_POSTREV_4_FREQ | 0x000C34 | Hz |
| PEQ_POSTREV_5_FREQ | 0x000C35 | Hz |
| TONE_KNOB | 0x000D00 | Value |
| PIEZO_BLEND | 0x000D01 | Value |
| OUTPUT_GAIN | 0x000D02 | Value |
| COIL_BRIDGE | 0x000E00 | ENUM |
| COIL_CENTER | 0x000E01 | ENUM |
| COIL_NECK | 0x000E02 | ENUM |
| SELECT_PU | 0x000E03 | |
| WAHWAH_FRQ | 0x000F00 | Hz |
| WAHWAH_STATE | 0x000F01 | ENUM |
| DELAY_TYPE | 0x000A04 | ENUM |
| MOD_TYPE | 0x001000 | ENUM |
| MOD_RATE | 0x001001 | Value |
| MOD_DEPTH | 0x001002 | Value |
| MOD_WET | 0x001003 | Value |
| REVERB_SIZE | 0x000B06 | Value |
| REVERB_DAMPING | 0x000B07 | Value |

The patch exchange command include additional features for exchanging and controlling the saved patches and may include a command type indicator and any data associated with the command type. Command type indicators may indicate a request for a 32 bit CRC value for a patch, an answer to the request for the 32 bit CRC value for the patch, and a request to set the name field of a patch, a request to get the name field of a patch, and an answer to the request to get the name field of a patch.

The request for a 32 bit CRC value for a patch includes the patch identifier the uniquely identifies the patch. A packet including a command indicating the request may include the need acknowledge flag set to require an acknowledgement. The patch CRC is a checksum over all of the values included in the identified patch. Every parameter's value is included in the CRC calculation after initialization. The sequence of inserting the parameters is defined by the unique key of each parameter, starting with the smallest and continuing with the next higher key until all of the parameters have been included in the CRC calculation. The CRC value is used to provide a fast comparison between a first patch stored at the first device and a second patch stored at guitar 102*a* to determine if there are any differences between the patches associated with the same patch identifier, but stored at the different devices.

The answer to the request for the 32 bit CRC value for the patch includes the patch identifier and the calculated CRC value for the patch. The answer command includes the acknowledgement to the requesting command.

The request to set the name field of a patch includes the patch identifier and a name to define for the patch. A packet including a command indicating the request may include the need acknowledge flag set to require an acknowledgement.

The request to get the name field of a patch includes the patch identifier and may include the need acknowledge flag set to require an acknowledgement.

The request to get the name field of a patch includes the patch identifier, the patch name, and the acknowledgement to the requesting command.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, the use of "and" or "or" is intended to include "and/or" unless specifically indicated otherwise. The illustrative embodiments may be implemented as a method, apparatus, or article of manufacture using standard programming and/or engineering techniques to produce software, firmware, hardware, or any combination thereof to control a computing element to implement the disclosed embodiments.

The foregoing description of illustrative embodiments of the invention have been presented for purposes of illustration and of description. It is not intended to be exhaustive or to limit the invention to the precise form disclosed, and modifications and variations are possible in light of the above teachings or may be acquired from practice of the invention. The embodiments were chosen and described in order to explain the principles of the invention and as practical applications of the invention to enable one skilled in the art to utilize the invention in various embodiments and with various modifications as suited to the particular use contemplated. It is intended that the scope of the invention be defined by the claims appended hereto and their equivalents.

What is claimed is:

1. An electronics module of an electric guitar comprising:

a processor mounted within a base of the electric guitar and configured to receive an audio signal generated by a vibration of one or more of a plurality of strings of the electric guitar, wherein the processor includes a microcontroller unit and a digital signal processor operably coupled to the microcontroller unit to communicate a data signal;

a plurality of controls mounted to the electric guitar, wherein the plurality of controls provide a mechanism for adjusting a sound created from the audio signal, and further wherein the plurality of controls are operably coupled to the processor;

an antenna operably coupled to the processor and configured to receive a wireless signal including an effects parameter from a first external device; and a computer-readable medium operably coupled to the processor, the computer-readable medium having computer-readable instructions stored thereon that, when executed by the processor, cause the electric guitar to:

determine a control of the plurality of controls associated with the received effects parameter;

adjust a state of the determined control based on the received effects parameter;

modify the audio signal based on the plurality of controls and on the received effects parameter; and output the modified audio signal through the antenna to a second external device.

2. The electronics module of claim 1, wherein the modified audio signal includes a digital signal.

3. The electronics module of claim 1, wherein the first external device and the second external device are the same device.

4. The electronics module of claim 1, wherein plurality of controls include one or more of:

a slider knob;

a tone control;

a switch;
a master control knob;
a fader slide knob;
a tape effect control;
a distortion control;
a toggle potentiometer;
a mode control.

5. The electronics module of claim 1, wherein the plurality of controls are operably coupled to the microcontroller unit and the microcontroller unit is configured to receive a state signal from the determined control, and further wherein the computer-readable instructions further cause the electric guitar to update the adjusted state of the determined control and to send information related to the updated state to the digital signal processor.

6. The electronics module of claim 1, wherein the antenna is operably coupled to the microcontroller unit and the microcontroller unit is configured to receive the effects parameter, and further wherein the computer-readable instructions further cause the electric guitar to update an effects value associated with the effects parameter and to send the updated effects value to the digital signal processor.

7. The electronics module of claim 1, wherein the audio signal is received by the digital signal processor, and the computer-readable instructions stored in the digital signal processor modify the audio signal based on the updated state and on the updated effects value.

8. The electronics module of claim 1, wherein the antenna is operably coupled to the processor through a wireless communication module configured to support the Bluetooth protocol.

9. An electric guitar comprising:
a body, the body comprising:
a base, wherein the base comprises a tailpiece mounted to the base;
a neck mounted to and extending from an end of the base; and
a headstock mounted to and extending from an end of the neck opposite the base,
wherein the neck comprises a plurality of string posts;
a plurality of strings mounted at a first end to the tailpiece and at a second end to the plurality of string posts;
a processor mounted within the base and configured to receive an audio signal generated by a vibration of one or more of the plurality of strings wherein the processor includes a microcontroller unit and a digital processor operably coupled to the microcontroller unit to communicate a data signal;
an antenna operably coupled to the processor and configured to receive a wireless signal including an effects parameter from a first external device;
a plurality of controls mounted to the body, wherein the plurality of controls provide a mechanism for adjusting a sound created from the audio signal, and further wherein the plurality of controls are operably coupled to the processor; and
a computer-readable medium operably coupled to the processor, the computer-readable medium having computer-readable instructions stored thereon that, when executed by the processor, cause the electric guitar to:
determine a control of the plurality of controls associated with the received effects parameter;
adjust a state of a determined control based on the received effects parameter;
modify the audio signal based on the plurality of controls and-on the received effects parameter to include one or more audio effects; and
output the modified audio signal through the antenna to a second external device.

10. The electric guitar of claim 9, wherein the first external device and the second external device are the same device.

11. The electric guitar of claim 9, further comprising an antenna operably coupled to the processor and configured to receive a wireless signal including at least a part of the effects parameter from a first external device.

12. A sound system comprising:
a sound receiving/producing device;
a control device; and
an electric guitar comprising
a body, the body comprising:
a base, wherein the base comprises a tailpiece mounted to the base;
a neck mounted to and extending from an end of the body; and
a headstock mounted to and extending from an end of the neck opposite the body, wherein the neck comprises a plurality of string posts;
a plurality of strings mounted at a first end to the tailpiece and at a second end to the plurality of string posts;
a processor mounted within the base and configured to receive an audio signal generated by a vibration of one or more of the plurality of strings;
a plurality of controls mounted to the body, wherein the plurality of controls provide a mechanism for adjusting a sound created from the audio signal, and further wherein the plurality of controls are operably coupled to the processor;
an antenna operably coupled to the processor and configured to receive a wireless signal including an effects parameter from the control device; and
a computer-readable medium operably coupled to the processor, the computer-readable medium having computer-readable instructions stored thereon that, when executed by the processor, cause the electric guitar to:
determine a control of the plurality of controls associated with the received effects parameter;
adjust a state of the determined control based on the received effects parameter;
modify the audio signal based on the plurality of controls and on the received effects parameter; and
output the modified audio signal through the antenna to the sound receiving/producing device.

13. The sound system of claim 12, wherein the control device and the sound receiving/producing device are the same device.

* * * * *